US008438801B2

(12) United States Patent
McLain et al.

(10) Patent No.: US 8,438,801 B2
(45) Date of Patent: May 14, 2013

(54) SUPPORT STRUCTURES ON ROOFS

(75) Inventors: Michael J. McLain, Green Bay, WI (US); Timothy Pendley, Madera, CA (US)

(73) Assignee: T&M Inventions, LLC, Green Bay, WI (US)

( * ) Notice: Subject to any disclaimer, the term of this patent is extended or adjusted under 35 U.S.C. 154(b) by 39 days.

(21) Appl. No.: 13/066,487

(22) Filed: Apr. 14, 2011

(65) Prior Publication Data

US 2012/0233942 A1 Sep. 20, 2012

Related U.S. Application Data

(63) Continuation-in-part of application No. 13/065,172, filed on Mar. 14, 2011.

(51) Int. Cl.

| | |
|---|---|
| ***E04B 7/18*** | (2006.01) |
| ***E04B 7/02*** | (2006.01) |
| ***E04B 7/04*** | (2006.01) |
| ***E06B 3/26*** | (2006.01) |

(52) U.S. Cl.

USPC ..... 52/200; 52/90.2; 52/91.1; 52/202

(58) Field of Classification Search ..... 52/200, 52/18, 72, 80.1, 90.1, 90.2, 91.1, 202, 19, 52/536, 537, 545

See application file for complete search history.

(56) References Cited

U.S. PATENT DOCUMENTS

| | | | | |
|---|---|---|---|---|
| 3,521,414 | A * | 7/1970 | Malissa | 52/107 |
| 3,791,088 | A | 2/1974 | Sandow et al. | |
| 3,828,494 | A | 8/1974 | Uhrhane et al. | |
| 3,967,423 | A | 7/1976 | Hammond | |
| 4,117,638 | A | 10/1978 | Kidd, Jr. et al. | |
| 4,123,883 | A * | 11/1978 | Barber et al. | 52/200 |

(Continued)

FOREIGN PATENT DOCUMENTS

| | | |
|---|---|---|
| GB | 981948 | 2/1965 |
| JP | 2000336859 | 5/2000 |

(Continued)

OTHER PUBLICATIONS

Cross-section and pictorial views of SSR-TUF-LITE daylighting panels, Jun. 20, 2012, 1 sheet.

(Continued)

*Primary Examiner* — Andrew Triggs

(74) *Attorney, Agent, or Firm* — Thomas D. Wilhelm; Wilhelm Law, S.C.

(57) ABSTRACT

Roof load supports support e.g. skylights and/or smoke vents, optionally including two or more closures in end-to-end relationship, from ribs of a metal roof. Where skylights are end-to-end over an aperture, mating strips support the skylights between upper and lower ends of the support structure. Supports of the invention are mounted above the water line whereby the number of water leaks about the mounting structure is greatly reduced. Water leakage is further reduced by re-designing the upper diverter and the lower closure, and providing for a second installation step. Condensation is further reduced by lifting the insulation inside the building to cover the sides of the closure support structure and providing a no-fastener securement of the insulation at an upper location in the closure support structure, and by providing thermally insulating materials as barriers to penetrating portions of fasteners, penetrating from outside the climate controlled building envelope.

34 Claims, 21 Drawing Sheets

U.S. PATENT DOCUMENTS

| | | | | | |
|---|---|---|---|---|---|
| 4,155,206 | A | | 5/1979 | Player | |
| 4,296,581 | A | | 10/1981 | Heckelsberg | |
| 4,470,230 | A | | 9/1984 | Weisner | |
| 4,520,604 | A | | 6/1985 | Halsey et al. | |
| 4,543,753 | A | * | 10/1985 | Sonneborn et al. | 52/15 |
| 4,559,753 | A | * | 12/1985 | Brueske | 52/748.1 |
| 4,621,466 | A | | 11/1986 | Sonneborn et al. | |
| 4,649,680 | A | | 3/1987 | Weisner et al. | |
| 4,703,596 | A | | 11/1987 | Sandow | |
| 4,730,426 | A | | 3/1988 | Weisner et al. | |
| 4,776,141 | A | * | 10/1988 | Powell | 52/200 |
| 4,825,608 | A | | 5/1989 | Makin | |
| 4,848,051 | A | | 7/1989 | Weisner et al. | |
| 4,860,511 | A | | 8/1989 | Weisner et al. | |
| 4,941,300 | A | * | 7/1990 | Lyons, Jr. | 52/58 |
| 4,986,039 | A | | 1/1991 | Weisner | |
| 5,027,576 | A | * | 7/1991 | Gustavsson | 52/748.1 |
| 5,323,576 | A | | 6/1994 | Gumpert et al. | |
| 5,511,354 | A | | 4/1996 | Eidson | |
| 5,522,189 | A | * | 6/1996 | Mortensen et al. | 52/200 |
| 5,553,425 | A | * | 9/1996 | Sampson et al. | 52/58 |
| 5,561,953 | A | | 10/1996 | Rotter | |
| 5,896,711 | A | * | 4/1999 | McClure | 52/200 |
| 5,960,596 | A | * | 10/1999 | Lyons, Sr. | 52/200 |
| 6,079,167 | A | | 6/2000 | Voegele, Jr. | |
| 6,151,838 | A | * | 11/2000 | Husein | 52/58 |
| 6,640,508 | B2 | | 11/2003 | Lindgren et al. | |
| 6,966,157 | B1 | * | 11/2005 | Sandow | 52/200 |
| 7,043,882 | B2 | | 5/2006 | Gumpert et al. | |
| 7,296,388 | B2 | | 11/2007 | Valentz et al. | |
| 7,308,777 | B2 | * | 12/2007 | Sandow | 52/200 |
| 7,395,636 | B2 | | 7/2008 | Blomberg | |
| 7,712,279 | B2 | * | 5/2010 | McClure | 52/580 |
| 7,721,493 | B2 | | 5/2010 | Skov et al. | |
| 7,736,014 | B2 | | 6/2010 | Blomberg | |
| 2004/0049996 | A1 | | 3/2004 | Blomberg | |
| 2005/0204674 | A1 | * | 9/2005 | Marshall | 52/544 |
| 2006/0191230 | A1 | | 8/2006 | Gumpert | |
| 2007/0094984 | A1 | | 5/2007 | McClure | |
| 2007/0101665 | A1 | | 5/2007 | Sandow | |
| 2008/0040993 | A1 | | 2/2008 | Valentz et al. | |
| 2008/0190050 | A1 | | 8/2008 | McClure | |
| 2010/0162643 | A1 | | 7/2010 | Blomberg et al. | |
| 2011/0252726 | A1 | | 10/2011 | McLain et al. | |
| 2011/0252727 | A1 | | 10/2011 | McLain et al. | |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Cross-section of VP TUF-LITE Panel—attached to the side of SSR rib, Jun. 20, 2012, 1 sheet.

Cross-section of Butler Lite Panel—attached to the side of MR24 rib, Jun. 20, 2012, 1 sheet.

FAA Facility, photos of skylight installation, 3 pages, Sacramento, CA.

Siemens Building, photos of skylight installation, 6 pages.

R & S Manufacturing and Sales Company, Inc., Standing Seam 24 Light, Quick Installation Instructions, Under/Over Seam Clip, 12 pages, Newbury Park, CA, date unknown.

R & S Manufacturing and Sales Company, Inc., SS 24 Light, The First Truely Thermally Broken Metal Building Skylight, informational sheet, 1 page, Newbury Park, CA, date unknown.

R & S Manufacturing and Sales Company, Inc., Enlarged photo of metal roof showing the down slope, 1 page, Newbury Park, CA, date unknown.

* cited by examiner

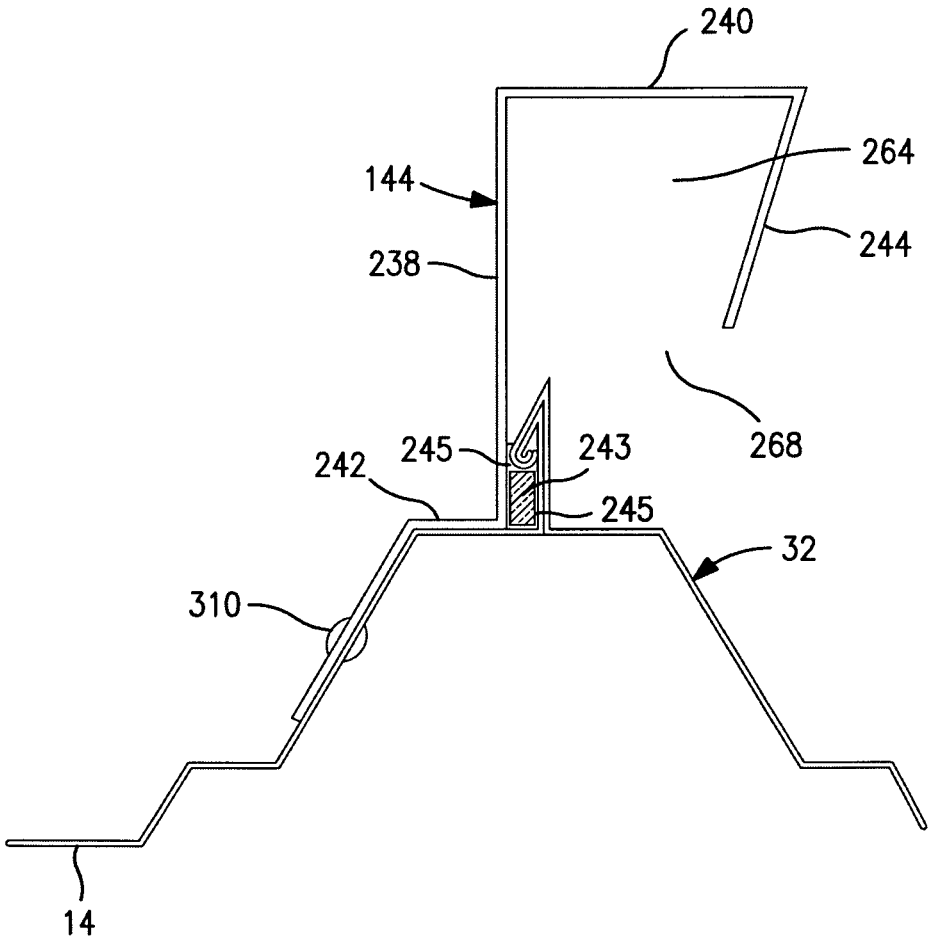
FIG. 8A1

SUPPORT STRUCTURES ON ROOFS

CROSS-REFERENCE TO RELATED APPLICATION

This application is a Continuation-In-Part application which claims priority under 23 U.S.C. §120 to application Ser. No. 13/065,172, filed Mar. 14, 2011.

BACKGROUND OF THE INVENTION

Various systems are known for supporting loads on roofs, and for installing skylights and/or smoke vents into roofs.

Commonly used skylighting systems have translucent or transparent closure members, also known as lenses, mounted on a support structure which extends through an aperture in the roof and is mounted to building support members inside the building. Ambient daylight passes through the lens and thence through the roof aperture and into the building.

Thus, conventional skylight and smoke vent installations use a complex structure beneath the exterior roofing panels and inside the building enclosure, in order to support a curb which extends through the roof and supports the skylight lens. Conventional skylight curbs, thus, are generally in the form of a preassembled box structure surrounding an aperture which extends from the top of the box structure to the bottom of the box structure. Such box structure is mounted to building framing members inside the building enclosure, and extends through a respective aperture in the roof, similar in size to the aperture which extends through the box structure. The skylight assembly thus mounts inside the building enclosure, and extends through an aperture in a separately mounted roof structure. Fitting skylight assemblies into such roof aperture, in a separately-mounted roof structure, presents problems. All known conventional structures have a tendency to leak water when subjected to rain.

In light of the leakage issues, there is a need for a more effective way to support skylights and smoke vents, thus to bring daylight into buildings, as well as a more effective way to support a variety of other loads, on roofs.

To achieve desired levels of daylighting, conventional skylight installations use multiple roof apertures spaced regularly about the length and width of a given roof surface through which daylight is to be received. Each skylight lens is installed over a separate such aperture; and the aperture for each such skylight assembly, each representing a single lens, extends across multiple elongate metal roof panels.

The opposing sides of conventional metal roof panels, to which skylight assemblies of the invention are mounted, are raised above elongate centralized panel flats which extend the lengths of the panels, whereby the sides of adjacent such roof structures are joined to each other in elongate joints, referred to herein as ribs. The aperture for a conventional skylight cuts across multiple such ribs in order to provide a large enough aperture to receive conventionally-available commercial-grade skylight assemblies. The skylight assembly, itself, includes a curb which is mounted inside the building and extends, from inside the building, through the roof aperture and about the perimeter of the aperture, thus to support the skylight lens above the flats of the roof panels, as well as above the ribs. Conventional pliable tube construction sealants are applied about the perimeter of the roof aperture, between the edges of the roof panels and the sides of the skylight assembly curb, including at the cut ribs. Typically, substantially all of such sealant is applied in the panel flats, which means that such sealant is the primary barrier to water leakage about substantially the entire perimeter of the skylight curb. One of the causes of roof leaks around the perimeter of conventional roof curbs which attach primarily through the panel flat at the water line are due to foot traffic, such as heel loads or other dynamic loads imposed by workers wheeling gas cylinders or other heavy equipment on the roof panel e.g. with dollies. This type of dynamic loading can cause high levels of stress on the joints that rely solely on mastic to provide seals in the wet areas, namely in the panel flats. Such leaks are common around fastener locations as the panels flex under load and cause the sealant to deform, such that in time passages develop through the sealant, which allows for the flow of water through such passages.

Such multiple curbs, each extending through a separate roof aperture, each sealed largely in the panel flats, create multiple opportunities for water to enter the interior of the building. Applicants have discovered that such opportunities include, without limitation, (i) the number of individual apertures in the roof,
(ii) the widths of the apertures, which require cuts through the multiple ribs,
(iii) the tendency of water to collect and stay at the upper ends of the aperture,
(iv) the disparate expansion and contraction of the roof panels relative to the skylight curb; and
(v) the length of sealed seams in the panel flats.

The traditional curb constructions and methods of attachment in most cases thus require that a complicated support structure be installed below the metal roofing and inside the building enclosure, which allows disparate/discordant movement of the metal roof panels and the skylight assembly relative to each other, as associated with thermal expansion and contraction of the metal roof e.g. in response to differences in temperature changes inside and outside the building.

In addition, conventional curb-mounted skylights tend to accumulate condensation, especially about fasteners which extend from the outside of the building to the inside of the climate-controlled building envelope.

Thus, it would be desirable to provide a skylight system which provides a desired level of daylight in a commercial and/or industrial building while substantially reducing the incidence/frequency of leaks occurring about such skylights, as well as reducing the incidence/frequency of condensate accumulation in the areas of such skylights.

It would also be desirable to provide a smoke vent system while substantially reducing the incidence/frequency of leaks occurring about such smoke vents, as well as reducing the incidence/frequency of condensate accumulation in the areas of such smoke vents.

It would further be desirable to provide a support system, suitable for supporting roof loads, up to the load-bearing capacity of the metal roof while substantially controlling the tendency of the roof to leak about such support systems, as well as reducing the incidence/frequency of condensate accumulation in the areas of such closure support systems.

SUMMARY OF THE INVENTION

The invention provides a curbless construction system for installing roof load supports such as roof closure structures, optionally skylights and/or smoke vents, optionally including two or more such roof closure structures in end-to-end relationship, onto the major rib elevations of a building's metal roof panel system, thereby utilizing the beam strength of the roof rib elevations on the surface of the roof, as the support for such loads. Where skylight assemblies are placed in end-to-end relationship over a common roof aperture, the upper diverter and lower closure at the facing ends of such skylight assemblies are replaced with male and female mating strips, thus to simplify such joinder while providing substantial barrier to water leakage at the abutting ends of the adjacent skylight assemblies. Numerous roof structures include such ribs and rib elevations, sometimes deemed "ribs" or "corrugations", including the standing seam, snap seam and "R" panel roof types. The roof support and/or closure structures of the invention are fastened to the rib structures of the metal roof panels above the water line. By mounting the loads above the water line, the number of incidents of water leaks, especially leaks about the mounting structure, is greatly reduced. By mounting the loads on the roof panels, themselves, the supported loads, such as skylights or vents, can move with the respective roof panels as the roof panels expand and contract.

The invention thus utilizes the beam strength of the rib elements of the roof panels as an integral part of the closure support structure.

In addition, the invention further improves control of water leakage and condensation formation inside the climate-controlled building envelope. Water leakage is reduced by redesigning the upper diverter and the lower closure, and providing for a second installation step, and by providing a male/female intermediate joint where skylight assemblies meet end to end intermediate the length of the roof aperture. Condensation is reduced by lifting the insulation inside the building to cover the sides of the closure support structure and providing a no-fastener securement of the insulation at an upper location in the closure support structure, and by providing thermally insulating materials as barriers to penetrating portions of fasteners, penetrating from outside the climate controlled building envelope, preventing such fasteners from entering the climate-controlled building envelope.

In a first family of embodiments, the invention comprehends apparatus adapted to be assembled to form a closed-perimeter closure support structure about a perimeter of an aperture extending through a roof of a building, such closure support structure extending up from such roof of such building and closing off access to such aperture from any side of the aperture, and wherein a passage extends, from a climate-controlled space inside such building, upwardly through such roof aperture and through the closure support structure, the apparatus comprising a plurality of closure members adapted to be mounted on the roof and about the aperture in the roof thereby to provide the closing off of access to the aperture from any side of the aperture. Each such closure member comprises one or more closure member panels, including one or more cavity panels which define an elongate cavity extending the length of the closure member, and an elongate slot defining an access path into the respective elongate cavity. The closure members, when assembled to each other, end to end, to thereby define the closed-perimeter closure support structure, defining the outer perimeter of the closure support structure about the roof aperture, and an outer surface of the outer perimeter. The plurality of closure members collectively define a single generally continuous elongate cavity about the perimeter of the closure support structure and inwardly of the outer surface of the outer perimeter, and a single generally continuous elongate slot providing a generally continuous elongate path into the single elongate cavity, the cavity having a generally continuous cavity length, a cavity height, and a cavity width, a dimension of at least one of the cavity height and the cavity width being less than a width dimension of the elongate slot.

In some embodiments, the closure members comprise (i) a first elongate side rail, comprising one or more elongate rail panels which define a first elongate such cavity, (ii) a second elongate side rail, comprising one or more elongate rail panels which define a second elongate such cavity, (iii) an upper diverter, comprising one or more diverter panels which define a third elongate such cavity, and (iv) a lower closure, comprising one or more lower closure panels which define a fourth elongate such cavity, the generally continuous elongate cavity about the outer perimeter of the closure support structure comprising the first, second, third, and fourth elongate cavities.

In some embodiments, the apparatus is assembled into such closure support structure and is mounted on a roof of a building about an aperture in the roof, a layer of insulation product being disposed below the roof, the layer of insulation product comprising a vapor barrier sheet, and a layer of thermally-insulating batt material, the vapor barrier sheet being drawn upwardly about the perimeter of the roof aperture and trapped inside the continuous elongate cavity about the perimeter of the roof aperture.

In some embodiments, the vapor barrier sheet traps a portion of the thermally-insulating batt material between itself and one or more of the closure member panels.

In some embodiments, the roof of the building comprises a plurality of elongate upstanding ribs extending between a ridge and an eave of the building roof, the ribs terminating in upstanding edges having folded-over terminal ends of the respective adjacent roof panels, the width dimension of the elongate slot being defined between a first cavity panel and one of a second cavity panel and the upstanding edge of the respective rib, the apparatus further comprising an elongate resilient rod, having a cross-section dimension greater than the width of the elongate slot, the elongate rod being disposed in the elongate cavity and trapping the vapor barrier sheet inside the elongate cavity, a closure panel optionally being mounted over the closure support structure and closing off access to the roof aperture.

In some embodiments fasteners which mount the closure panel to the closure support structure terminate in the elongate resilient rod.

In some embodiments, the apparatus is assembled into a closure support structure and is mounted on a roof of a building about an aperture in the roof, the closure members comprising (i) a first elongate side rail, comprising one or more elongate rail panels which define a first elongate cavity, (ii) a second elongate side rail, comprising one or more elongate rail panels which define a second elongate cavity, (iii) an upper diverter, comprising one or more diverter panels which define a third elongate cavity, and (iv) a lower closure, comprising one or more lower closure panels which define a fourth elongate cavity, the generally continuous elongate cavity about the outer perimeter of the closure support structure comprising the first, second, third, and fourth elongate cavities, the roof of the building comprising a plurality of elongate upstanding ribs extending between a ridge and an eave of the building, and panel flats between the ribs, the first and second side rails being mounted on adjacent ones of the ribs on opposing sides of a single panel flat and above the panel flat, the upper diverter extending between the first and second side rails and across the respective panel flat and providing closure, and sealing, of the closure support structure, across the panel flat at an upper end of the closure support structure, the lower closure extending between the first and second side rails and across the respective panel flat and providing closure, and sealing of the closure and support structure, across the panel flat at a lower end of the closure support structure.

In some embodiments, the side rails comprise outer rail panels extending upwardly from the ribs, the ribs terminating in upstanding edges having folded-over terminal ends of the respective adjacent roof panels, a space being disposed between the folded-over terminal ends and underlying portions of the ribs, further comprising, where the space is adjacent an outer rail panel, a closely-fitting rib plug in the space at a joint between the respective side rail and a respective one of the upper diverter and the lower closure, further comprising tube sealant extending about the rib plug and closing off a remainder of the space between the rib plug and the outer rail panel and between the rib plug and the folded-over terminal ends.

In some embodiments, the upper diverter comprises an upstanding end panel extending between the first and second side rails, and diverter ears extending from the end panel and folded over, and secured to, the side rails, such that the side rails are between the diverter ears and the roof aperture.

In some embodiments, the apparatus is assembled into a such closure support structure and mounted on a roof of a building about an aperture in the roof, the closure members comprising (i) a first elongate side rail, (ii) a second elongate side rail, (iii) an upper diverter, and (iv) a lower closure comprising a bottom portion and an upper rail, the bottom portion comprising (A) a closure web extending upwardly from a panel flat, and (B) a lower flange extending, from the closure web, toward the roof aperture, the lower flange being secured to the roof panel at the panel flat, optionally through an underlying stiffener plate, the upper rail being mounted to the closure web and extending, as a bearing panel, from the closure web toward the roof aperture, and extending, from the bearing panel, downwardly as an inside panel of the respective cavity.

In some embodiments, the apparatus is assembled into a closure support structure and mounted on a roof of a building about an aperture in the roof, the closure members comprising (i) a first elongate side rail, (ii) a second elongate side rail, (iii) an upper diverter, (iv) a lower closure, (v) first and second mating strips extending across the roof aperture between the first and second side rails, and disposed between the upper diverter and the lower closure, the first and second mating strips being mounted to the first and second side rails and being mated to each other so as to close a joint therebetween.

In some embodiments, the first and second mating strips further comprise bearing panels adapted to receive closure structure thereon, overlying portions of the roof aperture.

In some embodiments, the apparatus is assembled into a closure support structure and mounted on a roof of a building about an aperture in the roof, the closure structure support structure comprising (i) first and second elongate side rails mounted to the roof in end-to-end relationship, and a first connecting plate extending between, and mounted to, both of the first and second side rails, (ii) third and fourth elongate side rails mounted to the roof in end-to-end relationship, and a second connecting plate extending between, and mounted to, both of the third and fourth side rails, (iii) an upper diverter, and (iv) a lower closure.

In a second family of embodiments, the invention comprehends apparatus adapted to be assembled to form a closed-perimeter closure support structure about a perimeter of an aperture extending through a roof of a building, the closure support structure extending up from the roof and closing off access to the aperture from any side of the aperture, and wherein a passage extends, from a climate-controlled space inside the building, upwardly through the roof aperture and through the closure support structure, the apparatus comprising a plurality of closure members adapted to be mounted on the roof and about the aperture in the roof thereby to provide the closing off of access to the aperture, the closure members comprising (i) a first elongate side rail, (ii) a second elongate side rail, (iii) an upper diverter, (iv) a lower closure, comprising a bottom portion and an upper rail, the bottom portion comprising (A) a closure web adapted to extend upwardly from a panel flat, and (B) a lower flange extending generally perpendicularly from the closure web in a first direction, the upper rail being mounted to the closure web and extending, as a bearing panel, from the closure web in a direction in common with the lower flange.

In some embodiments, the apparatus is assembled into a closure support structure and mounted on a roof of a building about an aperture in the roof, the lower flange extending, from the closure web, toward the roof aperture, the upper rail lying in overlying relationship with respect to the lower flange and extending, from the closure web, toward the roof aperture.

In some embodiments, the apparatus is assembled into a closure support structure and mounted on a roof of a building about an aperture in the roof, and further comprises a closure panel, such as, without limitation, a skylight lens or lens assembly, or a smoke vent, mounted over the closure support structure and closing off access to the roof aperture.

In a third family of embodiments, the invention comprehends a method of mounting a load to a metal roof of a building, the method comprising mounting a closure support structure to the metal roof about an aperture in the roof, the metal roof having upstanding ribs at joints between respective metal roof panels, and panel flats between the ribs, and further comprising mounting first and second side rails in side-by-side relationship to adjacent ones of the ribs across a single panel flat and beside the roof aperture; mounting an upper diverter between the first and second side rails, across the panel flat and closing off access to the roof aperture at an upper end of the roof aperture; mounting a lower closure between the first and second side rails, across the panel flat and closing off access to the roof aperture at a lower end of the roof aperture, the lower closure comprising a bottom portion and an upper rail, the bottom portion comprising a closure web and a lower flange extending transversely to the closure web, the method further comprising (i) mounting the lower closure to the roof panel by driving fasteners through the lower flange and into the roof panel in the panel flat, with the lower flange extending from the closure web toward the roof aperture, and (ii) subsequently mounting the upper rail to the closure web, with a bearing panel of the upper rail extending from the closure web toward the roof aperture such that the bearing panel is in an overlying relationship over the lower flange.

In some embodiments, the method further comprises mounting a closure structure over the closure support structure and thereby closing off access to the roof aperture from outside the building.

In a fourth family of embodiments, the invention comprehends apparatus adapted to be assembled to form a closed-perimeter closure support structure and mounted on a roof of a building about a perimeter of an aperture extending through the roof of the building, the closure support structure extending from a first upper end thereof on the roof to a second lower end thereof on the roof, and extending in an upwardly direction from the roof of the building and closing off access to the aperture from any side of the aperture, and wherein a passage extends, from a climate-controlled space inside the building, upwardly through the roof aperture and through the closure support structure, the apparatus comprising (i) first and second elongate side rails adapted to be mounted to the roof in end-to-end relationship as a first side of the closure support structure, with the first side rail being disposed toward the first upper end of the closure support structure and the second side rail being disposed toward the second lower end of the closure support structure, and with a first joint being defined between the first and second side rails, (ii) third and fourth elongate side rails adapted to be mounted to the roof in end-to-end relationship as a second opposing side of the closure support structure, with the third side rail being disposed toward the first upper end of the closure support structure and the fourth side rail being disposed toward the second lower end of the closure support structure, and with a second joint being defined between the third and fourth side rails, (iii) an upper diverter adapted to extend between the first and third side rails at the first upper end of the closure support structure, (iv) a lower closure adapted to extend between the second and fourth side rails at the second lower end of the closure support structure, and (v) first and second mating strips adapted to extend across the roof aperture, from side rail to side rail, between the upper end and the lower end of the closure support structure, the first and second mating strips being adapted to be mounted to respective ones of the side rails and to be mated to each other so as to close a joint therebetween.

In some embodiments, the first and second mating strips further comprise bearing panels adapted to receive closure structure thereon, overlying portions of the roof aperture.

In some embodiments, the apparatus is assembled into a closure support structure and mounted on a roof of a building about an aperture in the roof, a first side of the closure support structure comprising the first and second elongate side rails, a second opposing side of the closure support structure comprising the third and fourth elongate side rails, the upper diverter extending between the first and second sides at the first upper end of the closure support structure, the lower closure extending between the first and second sides at the second lower end of the closure support structure, the first and second mating strips extending across the roof aperture between the first upper end and the second lower end, the first and second mating strips being mounted to respective ones of the side rails and being mated to each other so as to close a joint therebetween.

In some embodiments, the side rails, the upper diverter, and the lower closure, define bearing panels which collectively extend about an outer perimeter of the closure support structure in a common imaginary plane, first and second mating strips extending across the roof aperture intermediate the upper and lower ends of the closure support structure and also including bearing panels in the same imaginary plane, thereby to define a first bearing panel perimeter adapted to receive a first closure panel over a first portion of the roof aperture, and a second bearing panel perimeter adapted to receive a second closure panel over a second portion of the roof aperture.

In some embodiments, the apparatus further comprises first and second closure panels over the respective first and second portions of the roof aperture.

In some embodiments, the first and second closure panels, collectively with minor portions of the closure support structure, overlie the entirety of the single roof aperture.

The present invention will be further appreciated and understood when considered in combination with the following description and accompanying drawings. It will be understood, however, that the following description is by way of illustration and not of limitation. Certain changes and modifications can be made within the scope of the invention without departing from the spirit of the invention, and the invention includes all such changes and modifications.

BRIEF DESCRIPTION OF THE DRAWINGS

FIG. 8A1 is an enlarged end view of a rail mounted at a standing seam, and illustrating a gap plug in the space between the outer panel of the rail and the metal roof seam, under the turned-over edges of the seam.

Figure 1:
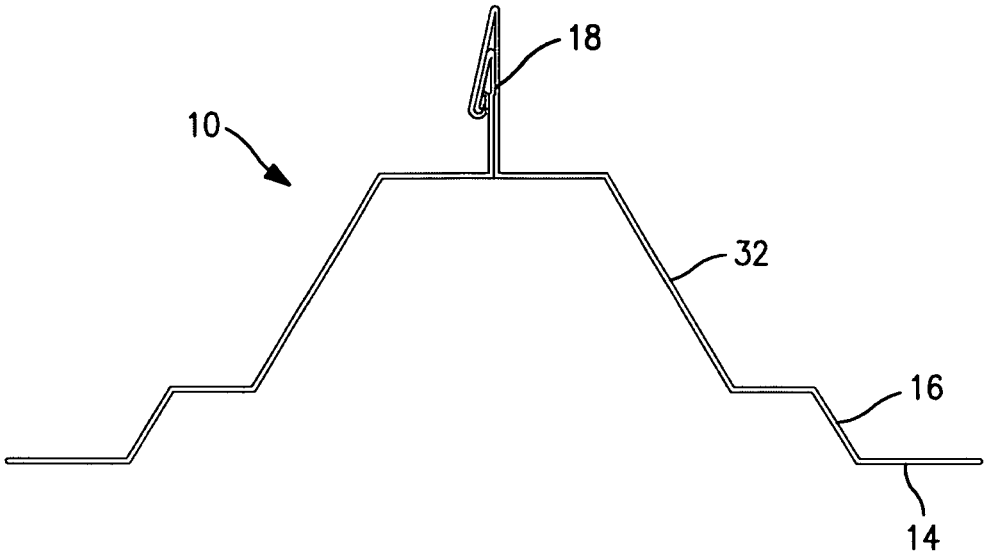
FIG. 1 is a roof profile of a metal roof of the type known as the standing seam roof.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

The products and methods of the present invention provide a load support structure, for use in installing various exterior roof loads, including structures which close off apertures in metal roofs. For purposes of simplicity, "closure support structure" will be used interchangeably to mean various forms of closed-perimeter structures which are mounted on ribs of raised elevation metal roof structures, including across the flat of a roof panel, and which collectively define an upstanding enclosing wall which defines a surrounded space about an aperture in a roof, and supports either a closure over the aperture, or a conduit which extends through the roof aperture. Skylight assemblies and smoke vents are non-limiting examples of closures over such roof apertures. Air handling operations such as vents, air intake, and air or other gaseous exchange to and/or from the interior of the building are non-limiting examples of operations where conduits extend through the roof aperture. In the case of roof ventilation, examples include simple ventilation openings, such as for roof fans, and smoke vents, which are used to allow the escape of smoke through the roof during fires. In the case of exterior loads on the roof, where no substantial roof aperture is necessarily involved there can be mentioned, without limitation, such loads as air conditioners, air handlers, solar panels and other equipment related building utilities, and/or to controlling water or air temperatures inside the building. The only limitation regarding the loads to be supported is that the magnitude of a load must be within the load-bearing capacity of the roof panel or panels to which the load is mounted.

The number of skylights or other roof loads can vary from one load structure, to as many load structures as the building roof can support, limited only by the amount of support available from the respective roof panels to which the load is attached.

The invention provides structure and installation processes, as a closure system which utilizes the beam strength of the major rib structures, in the roof panels, as the primary support structure for mounting and fastening the e.g. skylight assembly to the roof. Typical conventional skylight installations do not allow for skylights to be mounted to each other, end to end, in continuous runs without intervening roof structure along the lengths of such runs. Rather, typical conventional skylight installations use a curb construction surrounding and supporting each skylight lens, the curb structure being typically 2-4 times wider than the metal roof panels and extending through the roof aperture from mounting locations inside the climate-controlled building envelope. The widths of skylights of the invention generally correspond to the widths of the metal roof panels to which such skylights are mounted. Thus, such conventional skylight curb structures are typically 2-4 times wider than the skylight support structure used in the present invention.

One family of closure support systems of the invention comprehends a skylight system which does not require support from the building framing inside the climate-controlled building enclosure for the purpose of supporting the skylight installation. Neither does the skylight system of the invention require a separate curb construction surrounding each skylight lens to separately support or mount or attach each skylight to the roof. Rather, the closure support structure of the invention, which supports such skylights, is overlaid onto, and mounted to, the roof panels, and exposes the closure support structure to the same ambient weather conditions which are experienced by the surrounding roof panels, whereby the closure support structure experiences approximately the same thermal expansions and contractions as are experienced by the respective roof panel or panels to which the closure support structure is mounted. This is accomplished through direct attachment of the closure support structures of a skylight of the invention to the underlying metal roofing panels. According to such roof mounting, and such ambient weather exposure, expansion and contraction of the closure support structure generally coincides, at least in direction, with concurrent expansion and contraction of the metal roof panels.

Referring now to the drawings, a given metal roof panel generally extends from the peak of the roof to the respective eave. Skylight systems of the invention contemplate the installation of two or more adjacent skylight assemblies in an end to end relationship along the major rib structure of a given such metal roof panel on the building whereby the individual skylight assemblies are installed in strips over a continuous, uninterrupted aperture in the metal roof, the aperture extending along a line which extends from the roof ridge to a corresponding eave.

Skylight systems of the invention can be applied to various types of ribbed roof profiles. FIG. 1 is an end view showing a roof profile of a metal roof of the type known as a standing seam roof. These include the "standing seam" roof, which has trapezoidal elevated elongate major ribs 32 typically 24" to 30" on center. Each roof panel 10 also includes a panel flat 14, and may include a shoulder 16 between a rib 32 and the panel flat. The elevated ribs on a given panel cooperate with corresponding elevated elongate ribs on next-adjacent panels, thus forming standing seams 18. Seams 18 represent the edges of adjacent roof panels, folded one over the other, to form elongate joints at the side edges of the respective roof panels. The rib elevations on respective adjacent panels are folded over such that the standing seams function as folded-over raised joints between the respective panels, thus to inhibit water penetration of the roof at the standing seams/joints.

Figure 2:
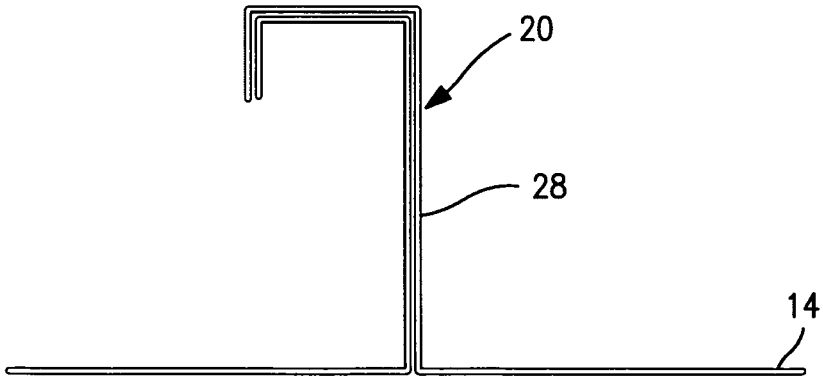
FIG. 2 is a roof profile of a metal roof of the type known as an architectural standing seam roof.

FIG. 2 is an end view showing the roof profile of a metal roof of the type known as an architectural standing seam roof, which uses a series of overlapping architectural standing seam panels 20. Each panel 20 comprises a panel flat 14, and a rib element of an architectural standing seam 28 on each side of the panel.

Figure 3:
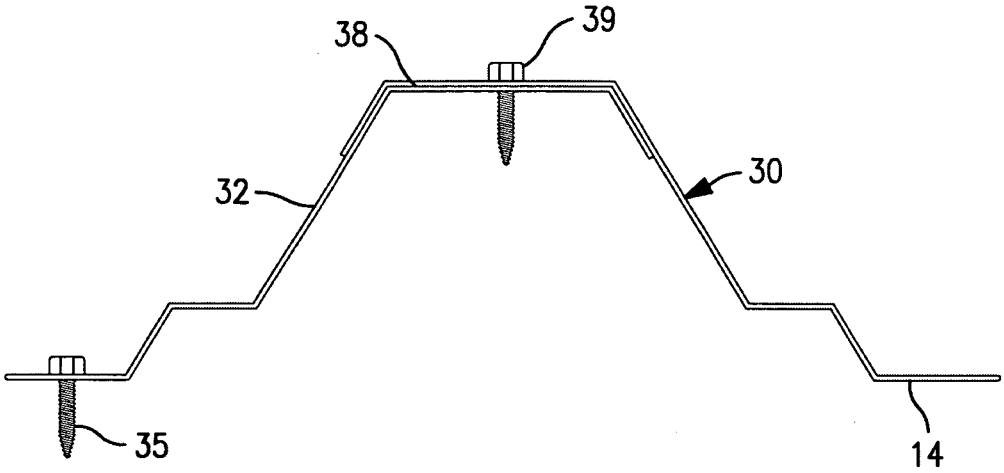
FIG. 3 is a roof profile of a metal roof of the type commonly referred to as a snap seam roof.

FIG. 3 is an end view showing the roof profile of a metal roof of the type commonly referred to as an "R panel" or exposed fastener panel 30. Each panel has elements on opposing sides of a panel flat 14 which, with the rib elements of adjacent panels, form ribs 32. Adjacent R panels are secured to the roof by fasteners 35. At side lap 38, overlapping regions of adjacent panels are secured to each other by stitch fasteners 39. Trapezoidal major ribs of the R panel roof are most typically formed at 8 inches to 12 inches on center.

Figure 4:
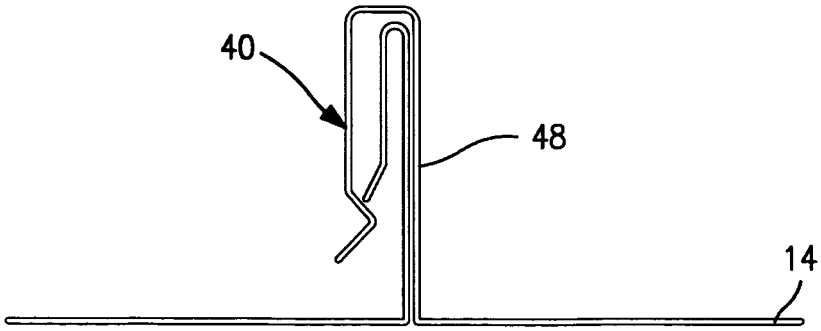
FIG. 4 is a roof profile of a metal roof of the type commonly referred to as an exposed fastener roof.

FIG. 4 is an end view showing the roof profile of a metal roof of the type commonly referred to as a snap rib seam panel 40. Snap seam panels 40 have a panel flat 14 and a standing seam or snap seam 48 where the adjacent panels meet.

Figure 5:
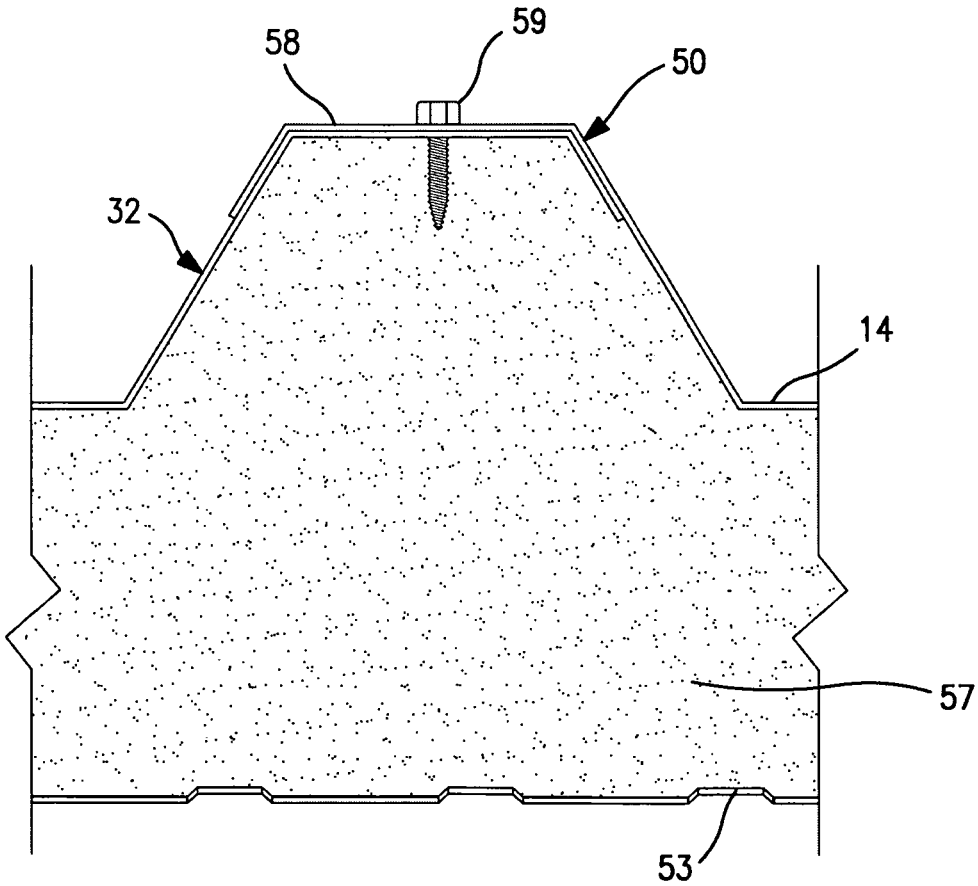
FIG. 5 is a roof profile of a metal roof of the type commonly known as a foam core roof.

FIG. 5 is an end view showing a roof profile of a metal roof of the type commonly referred to as a foam core panel 50. Such roof has a rib 32, a liner panel 53, a panel flat 14 and a foam core 57. Overlapping regions 58 of adjacent panels are secured to each other by fasteners 59.

A skylight/ventilation closure support structure is illustrative of closure structures of the invention which close off roof-penetrating apertures. Such closure support structure includes a rail and closure structure which surrounds the aperture in the roof, and which is adapted to be mounted on, and supported by, the prominent standing elevations, standing rib structures, or other upstanding elements of conventional such roof panels, where the standing structures of the roof panels, namely structure which extends above the panel flats, e.g. at seams/joints where adjoining metal roof panels are joined to each other, provides the support for the closure support structures. A such closure structure is secured to the conventional metal roofing panels, and surrounds a roof aperture formed largely in the intervening flat region of a single metal roof panel.

Figure 6:
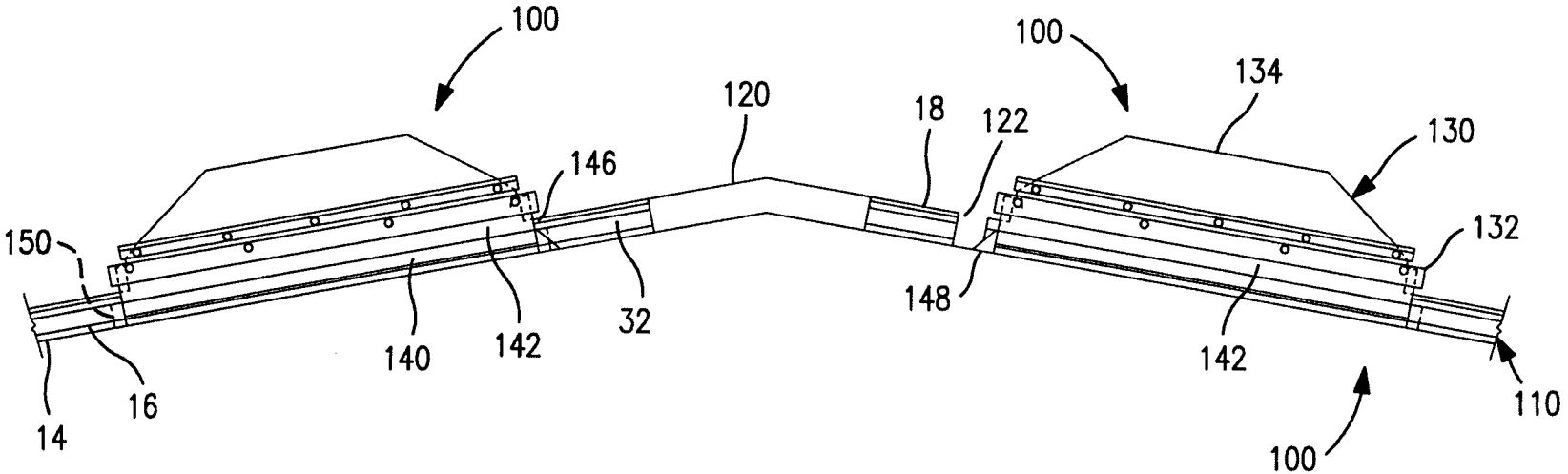
FIG. 6 is a side view showing major components of a skylight system of the invention, installed on a metal roof.

FIG. 6 shows first and second exemplary closure support structures 100, mounted to a sloping metal standing seam panel roof 110, and overlain by closures defined by first and second skylight lens assemblies 130.

Figure 7:
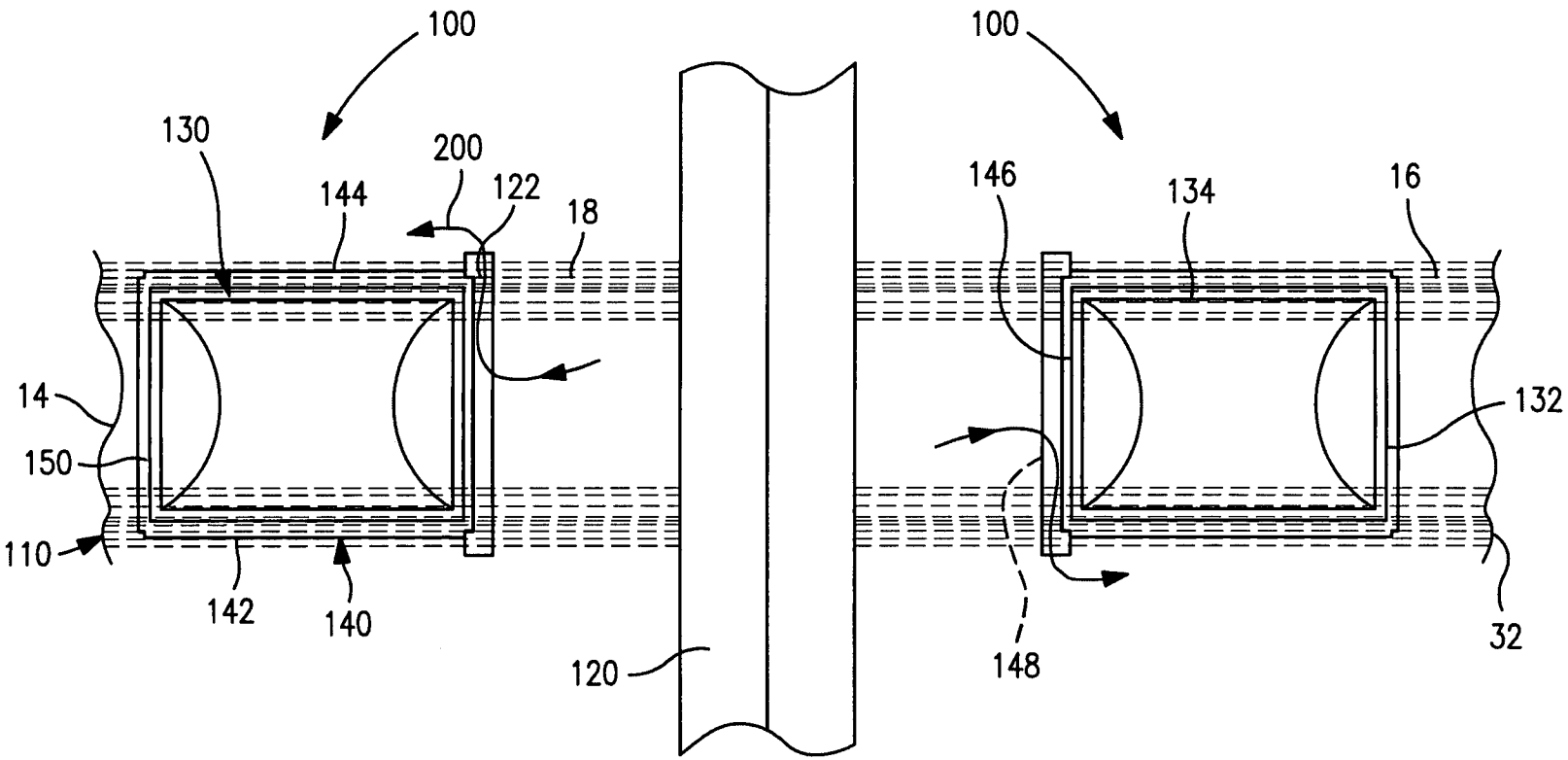
FIG. 7 is a top plan view of the installed skylight system of FIG. 6, showing placement of the skylights and the direction of water flow around the skylights.

FIG. 7 shows a portion of the roof 110 of FIG. 6, in dashed outline. The roof has a raised rib 32, a panel flat 14, shoulder 16 and standing seam 18. Given that water generally seeks the lowest level available at any given location, any water on a given roof panel tends to congregate/gather on the panel flat whereby, except for any dams across the panel flat, the water line is generally limited to the panel flat. Thus, rib 32, shoulder 16, and standing seam 18 are all typically above the water line. Also depicted in FIGS. 6 and 7 are ridge cap 120 of the sloping metal panel roof structure, and cutaway regions, or gaps 122 in the raised ribs 32, the gaps being formed to facilitate installation of the closure system, as described more fully following.

Skylight assembly 130, which is part of the aperture closure system, generally comprises a skylight lens frame 132 mounted to the closure support structure and extending about the perimeter of a given closure support structure, in combination with a skylight lens 134 mounted to, and overlying, frame 132. An exemplary such skylight lens is that taught in U.S. Pat. No. 7,395,636 Blomberg and available from Sunoptics Prismatic Skylights, Sacramento, Calif.

Figure 7A:
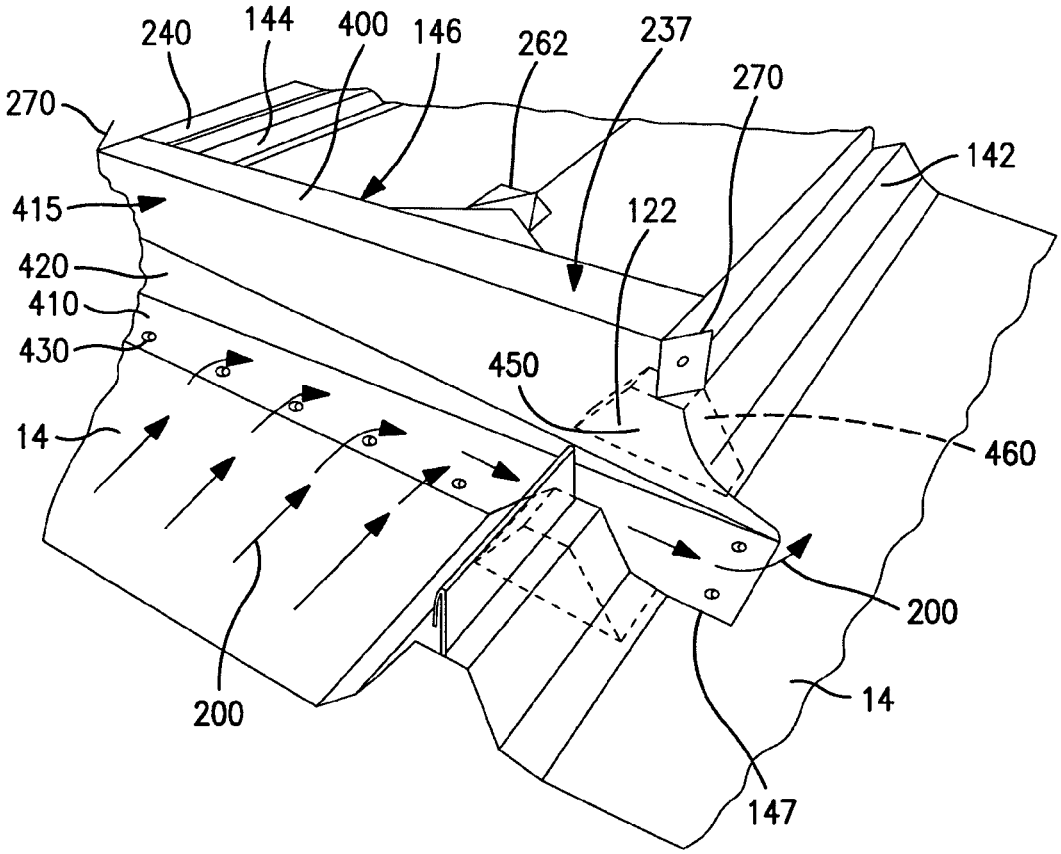
FIG. 7A is a cut-away pictorial view showing the upper diverter mounted in the rail gap.

Still referring to FIGS. 6, 7, and 7A, closure support structure 100 of the invention, as applied to a skylight installation, includes a rail and closure structure 140. Such rail and closure structure includes one or more first side rails 142 and one or more second side rails 144 (FIGS. 8A, 8A1), an upper diverter 146 disposed at an up-slope end of the enclosing wall of support structure 140, adjacent rib cutaway section, or gap 122, and a lower closure 150 at a down-slope end of the enclosing wall. As shown in FIG. 7A, a lateral leg 147 of the upper diverter is located in gap 122, filling the bottom and lower side of the gap and carrying water laterally across the width of the respective rib, to the panel flat 14 of the adjacent roof panel, thus to transport the water away from the upper end of the skylight and to prevent the water from leaking through the roof opening. Rail and closure structure 140 also includes support plates, connectors, bridging members, and rubber or plastic plugs to make various connections to the rail and closure structure elements as well as to close gaps/spaces between the various rail and closure structure elements, and between the roof panels and the rail and closure structure elements, thus to complete the seals which prevent water leakage about the skylight and its associated aperture in the roof.

FIGS. 7 and 7A show how gap 122 in rib 32, in combination with upper diverter 146, provides for water flow, as illustrated by arrows 200, causing the water to move laterally along the roof surface, over lateral leg 147 of the upper diverter, and down and away from the roof ridge cap 120 in panel flat 14 of the roof panel which is next adjacent the roof structures which support the respective e.g. skylight.

Lower closure 150 closes off the roof aperture from the outside elements at the lower end of the e.g. skylight or strip of skylights, thus to serve as a barrier to water leakage at the lower end of the aperture in the roof.

Figure 8A:
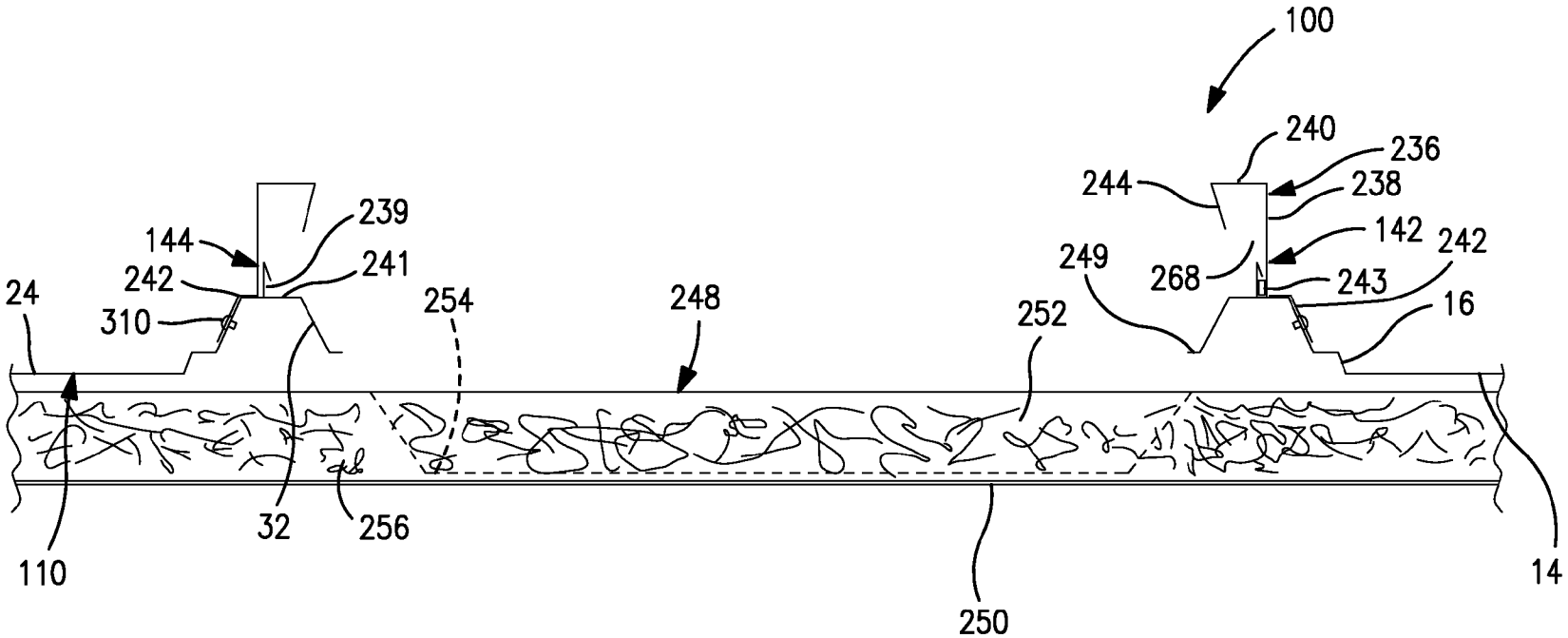
FIG. 8A is a cross sectional view showing the connections of the rails to the rib elevations of a metal panel roof where the panel flat has been removed; the rail structure being affixed to the surfaces of adjacent rib elevations, wherein the portion of the underlying insulation which is to be removed is shown above a dashed outline, and a gap plug has been installed between the standing seam and the rail on the right side of the drawing, providing relatively solid mass in the gap between the folded-over standing seam and the side of the rail.

Referring now to FIGS. 8A and 8A1, a cross section through rib 32, and associated closure support structures 100 shows securement of the closure support structures 100 to standing rib portions of the standing seam panel roof 110. FIG. 8A depicts the use of ribs 32 to support side rails 142 and 144 on opposing sides of the panel flat 14. Each rail 142 or 144 has a lower rail shoulder 242 and a rail upper support structure 236. Rail upper support structure 236 has a generally vertically upstanding outer panel 238, a generally horizontal rail upper flange or bearing panel 240, and a rail inside panel 244. Inside panel 244 extends toward outer panel 238 at an included acute angle of about 75 degrees between panel 240 and panel 244. Outer panel 238, bearing panel 240, and inside panel 244 each define a cavity wall, and such cavity walls collectively define a cavity 264 in the upper portion of the respective side rail.

Rail shoulder 242 is shaped to fit closely over the outside of the roof rib 32, and is secured to roof rib 32 by fasteners 310 spaced along the length of the rib.

In each rib joint, the edges of the two roof panels are folded together, one over the other, leaving a space 239 between the bottom edges of the folded over panel edges and the underlying top flat surface 241 of the rib. Where the space 239 faces the outer panel of the rail, as at the right side of FIG. 8A, and as shown in FIG. 8A1, a gap plug 243 is disposed in space 239 between the turned-over edge of the standing seam and the outer panel of the rail. Gap plugs 243 are used both where the upper diverter meets the side rails and where the lower closure meets the side rails.

Where space 239 faces away from outer panel 238 of the side rail, as at the left side of FIG. 8A, the flat surface of outer panel 238 can be brought into a close enough relationship with the standing seam that any spaces between the standing seam and the outer panel can be closed by pliable tube sealants. Thus, no gap plug is typically used between outer panel 238 and the standing seam where the edge of the seam is turned away from the outer panel.

Gap plug 243 is relatively short, for example about 1.5 inches to about 2.5 inches long, and has a width/height cross-section, shown in FIG. 8A1, which loosely fills space 239. The remainder of the space 239, about plug 243, namely between plug 243 and outer panel 238, and between plug 243 and the standing seam, is filled with e.g. a pliable construction sealant 245. Such sealant is shown in FIG. 8A1 as a solid dark outline about plug 243. Plug 243 thus provides a solid fill piece at spaces 239 where there is some risk of water entry into the aperture, and where the space 239 is too large for assurance that a more pliable sealant can prevent such water entry.

A gap plug 243 is made of a relatively solid, yet resilient, e.g. EPDM (ethylene propylene diene monomer) rubber, which provides relatively solid e.g. relatively non-pliable mass in space 239 between the folded-over standing seam and outer panel 238 of the rail, and relatively pliable, putty-like, tape mastic and tube caulk or the like are used to fill the relatively smaller spaces which remain after the gap plug has been inserted in the respective gap/space. Bearing panel 240, at the top of the rail, is adapted to support skylight frame 132, seen in FIG. 8D. Inside panel 244 of the rail extends down from the inner edge of bearing panel 240. Capture panel 246 extends at an obtuse included angle, illustrated at about 135 degrees, from the lower end of inside panel 244.

Referring back to FIG. 8A, insulation 248 is shown below the aperture 249 in the metal roof panel. Insulation 248 has a facing sheet 250 underlying a layer of e.g. fiberglass batt material 252. Dashed line 254 outlines the approximate portion of the fiberglass batt material which is to be removed. An edge portion 256 of batt material is left extending into aperture 249 for use described e.g. with respect to FIG. 8C.

Rail and closure structure 140 is representative of closure support structure 100. Rails 142, 144 fit closely along the contours of ribs 32. Upper diverter 146 and lower closure 150 have contours which match the cross-panel contours of the respective ribs 32 as well as flats 114. The various mating surfaces of structure 140 and roof 110 can be sealed in various ways known to the roofing art, including caulk or tape mastic. Plastic or rubber fittings or inserts such as plugs 243 and 460 can be used to fill larger openings at the rails and ribs.

Figure 8B:
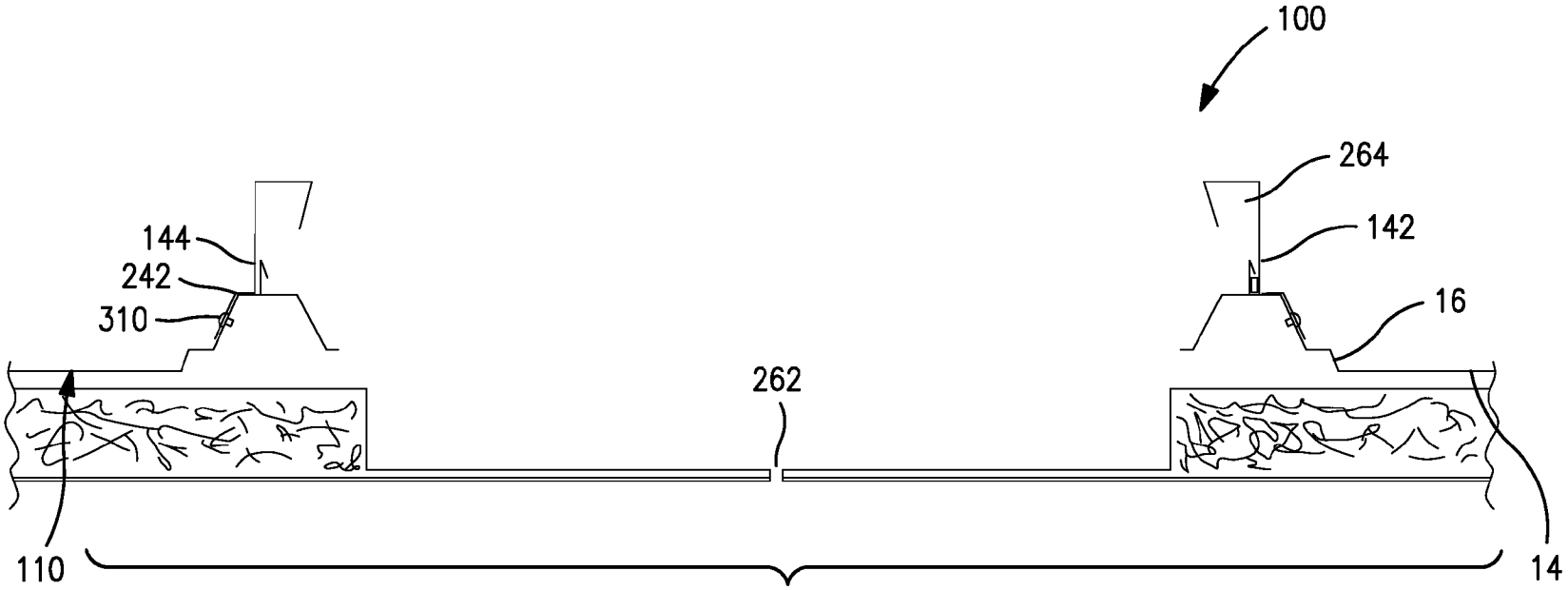
FIG. 8B shows a cross-section as in FIG. 8A, after removal of that portion of the insulation which was to be removed, and the insulation facing sheet cut down the middle along the length of the aperture/opening in the metal roof.

FIG. 8B shows the insulation batt material, marked with a dashed outline in FIG. 8A, removed from its position under the central portion of the aperture in the metal roof panel, cleaning substantially all of the batt material from that portion of the facing sheet. The facing sheet is then cut the full length of the roof-penetrating aperture 249 over which the one or more skylight lenses are to be installed. At the ends of aperture 249, the cut is spread to the corners of the aperture. A such "Y"-shaped cut 262 is illustrated at the upper end of the aperture in FIG. 7A, wherein the ends of the "Y" extend to approximately the upper corners of the aperture.

Figure 8C:
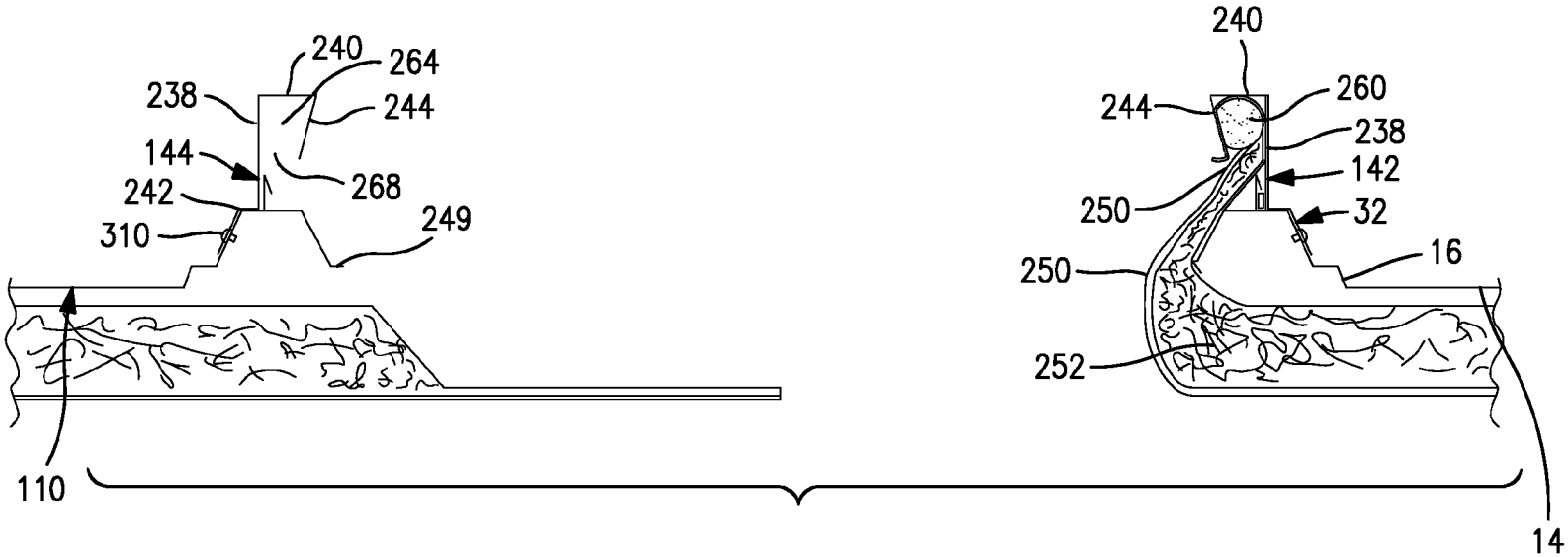
FIG. 8C shows a cross-section as in FIGS. 8A and 8B wherein the insulation facing sheet on one side of the aperture/opening has been raised and tucked into the cavity in the rail, and is being held in the cavity by a thermally-insulating compressible foam retainer rod.

FIG. 8C shows one side of the facing sheet lifted out of the aperture 249. The facing sheet and edge portion 256 of the insulation batting have been raised. A resilient foam retaining rod 260 has been forced into cavity 264 in the rail, with the insulation product extending up alongside, and contacting, the outer panel and captured, and being held, between the retaining rod and the rail surfaces which define cavity 264, which holds the insulation batting of edge portion 256 against the respective rib 32. Facing sheet 250 enters cavity 264 against outer panel 238 of the rail, extends up and over/about rod 260 in the cavity, and thence extends back out of cavity 264 to a terminal end of the facing sheet outside cavity 264. Thus, rod 260 positions edge portion 256, as thermal insulation, against rib 32, and also positions the facing sheet vapor barrier between the climate-controlled space 266 inside the building and the perimeter of the closure support structure.

The uncompressed, rest cross-section of rod 260 in cavity 264 is somewhat greater than the slot-shaped opening 268 between inside panel 244 and outer rail panel 238. Thus retainer rod 260 necessarily is deformable, and the cross-section of the rod is compressed as the rod is being forced through opening 268. After passing through opening 268, rod 260 expands against panels 238, 240, 244 of the cavity while remaining sufficiently compressed to urge facing sheet 250 against panels 238, 240, 244, and 246 of the cavity whereby facing sheet 250 is assuredly retained in cavity 264 over the entire length of the rail or rails. A highly resilient, yet firm, polypropylene or ethylene propylene copolymer foam is suitable for rod 260. A suitable such rod, known as a "backer rod" is available from Bay Industries, Green Bay, Wis.

Upper diverter 146 and lower closure 150, discussed in more detail hereinafter, extend across the flat of the metal roof panel adjacent the upper and lower ends of roof aperture 249 to complete the closure of closure support structure 100 about the perimeter of the skylight aperture. The upper diverter and the lower closure have upper support structures 237 having cross-sections corresponding to the cross-sections of upper support structures 237 of rails 142, 144. Those upper support structures thus have corresponding flange cavities which are used to capture facing sheet 250 at the upper diverter and lower closure. Thus, the facing sheet is trapped in a cavity at the upper reaches of the rail and closure structure about the entire perimeter of the rail and closure structure. Bridging tape or the like is used to bridge between the side portions and end portions of insulation facing sheet 250, such that the facing sheet completely separates the interior of skylight cavity 274 from the respective elements of closure support structure 100.

Figure 8D:
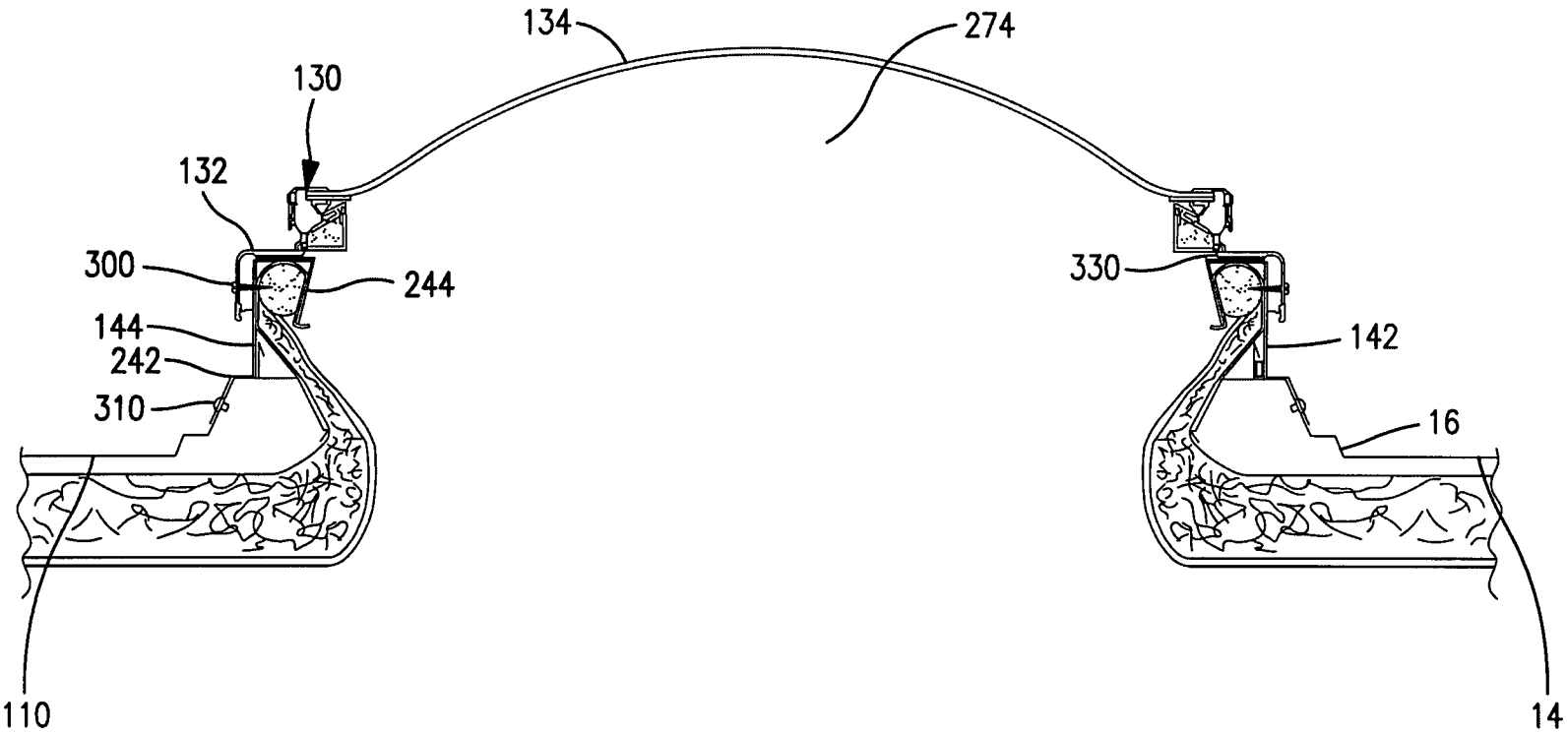
FIG. 8D shows a cross-section as in FIGS. 8A-8C wherein the facing sheet on both sides of the aperture/opening has been tucked into the rail cavity and is being held in the cavity by the foam retainer rod shown in FIG. 8C; and the skylight lens subassembly has been mounted to the rails, serving as a closure of the aperture in the metal roof.

FIG. 8D shows facing sheet 250 trapped in the rail cavities on both sides of the roof aperture. FIG. 8D further shows the skylight subassembly, including frame 12 and lens 134, mounted to rails 142, 144. A sealant 330 is disposed between bearing panel 240 and skylight frame 132, to seal against the passage of water or air across the respective joint. A series of fasteners 300 extend through outer panel 238 of the rail and extend into resilient rod 260, whereby rod 260 insulates the inside of the roof aperture from the temperature differential, especially cold, transmitted by fasteners 300, thereby to avoid fasteners 300 being a source of condensation inside the skylight cavity 274, namely below the skylight lens. In addition, frame 132 provides a thermal break between the inside of the frame and the ambient environment.

Figure 9:
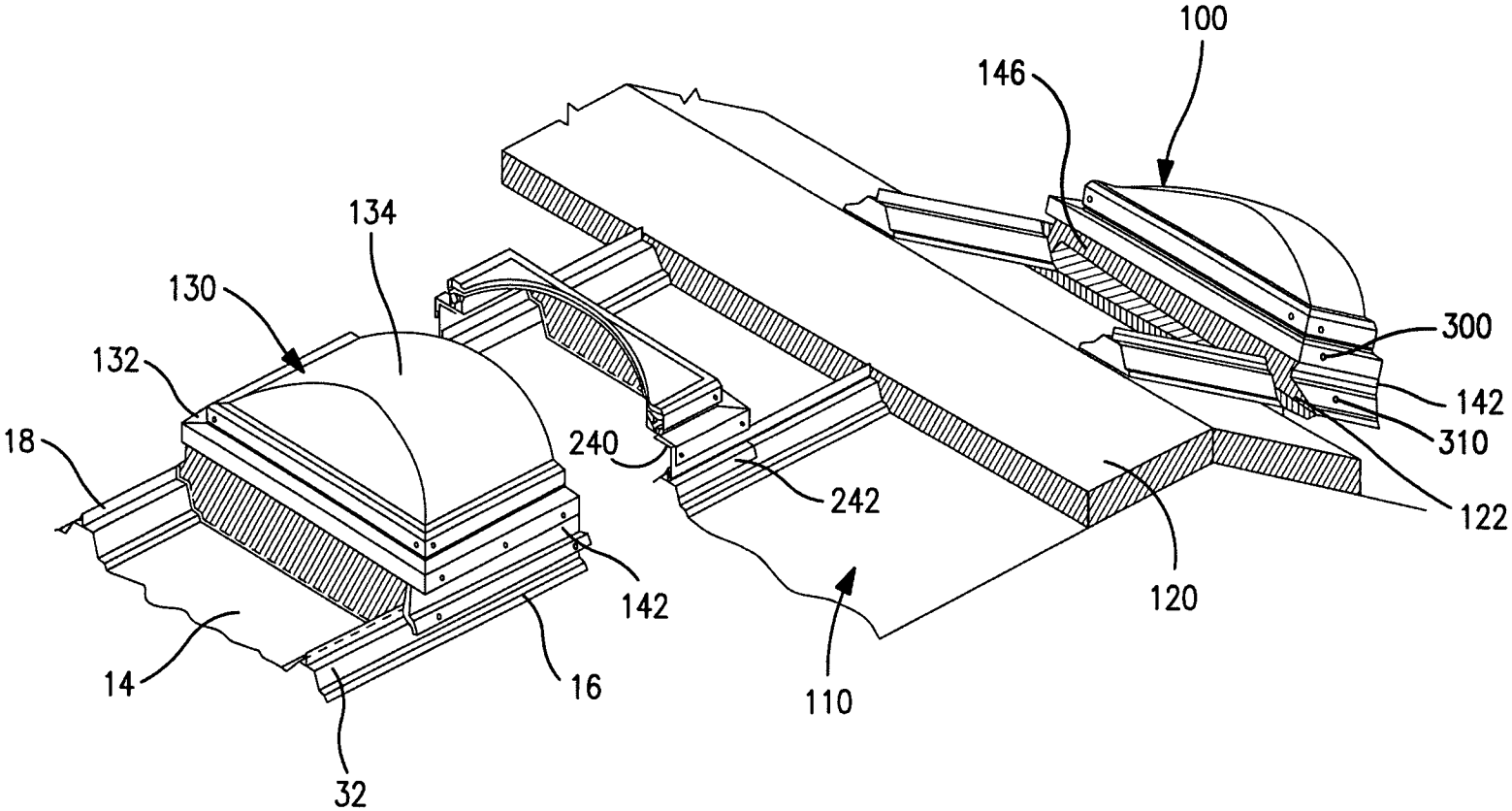
FIG. 9 is a perspective view partially cut away showing internal structure of the system as installed on the rib elevations of a metal roof.

In FIG. 9 a partially cut away perspective view of rail and closure structures 140 is used to show support of the rail and closure structure by standing seam panel roof 110, particularly the elevated rib 32 providing the structural support at the standing seams. FIG. 9 illustrates how the rail and closure structures cooperate with the structural profiles of the roof panels of the metal roof structure above and below the skylights, including following the elevations and ribs in adjacent ones of the panels, and thereby providing the primary support, by the roof panels, for the loads imposed by the skylights. In this fashion, the closure support structures of the invention adopt various ones of the advantages of a standing seam roof, including the beam strength features of the ribs at the standing seam, as well as the water flow control features of the standing seam.

Most standing seam roofs are seamed using various clip assemblies that allow the roof panels to float/move relative to each other, along the major elevations, namely along the joints between the respective roof panels, such joints being defined at, for example, elevated ribs 32. By accommodating such floating of the panels relative to each other, each roof panel is free to expand and contract according to e.g. ambient temperature changes irrespective of any concurrent expansion or contraction of the next-adjacent roof panels. Typically, a roof panel is fixed at the eave and allowed to expand and contract relative to a ridge. In some roofs, the panels are fixed at midspan, whereby the panels expand and contract relative to both the eave and ridge.

The design of the skylight systems of the invention takes advantage of such floating features of contemporary roof structures, such that when skylight assemblies of the invention are secured to respective rib elevations as illustrated herein, the skylight assemblies, themselves, are supported by the roof panels at ribs 32. Thus, the skylight assemblies, being carried by the roof panels, move with the expansion and contraction of the respective roof panels to which they are mounted.

FIG. 9 shows panel flat 14, rib 32, and shoulder 16, as well as standing seam 18. Ridge cap 120 is shown at the roof peak. Gap 122 in a rib 32 is shown at upper diverter 146.

As seen in FIG. 8D, skylight frame 132 is secured by a series of fasteners 300 to rail and closure structure 140 at side rails 142 and 144, and rails 142 and 144 are secured to ribs 32 by a series of fasteners 310.

In the process of installing a skylight system of the invention, a short length of one of the ribs 32, to which the closure support structure is to be mounted, is cut away, forming gap 122 in the respective rib, to accommodate drainage at the upper end of the rail and closure structure (toward ridge cap 120). Such gap 122 is typically used with standing seam, architectural standing seam, and snap seam roofs, and can be used with any other roof system which has elevated elongate joints and/or ribs. In some instances, the ribs on both sides of the skylight may be cut.

The retained portions of rib 32, namely along the full length of the skylight as disposed along the length of the respective roof panel, provide beam-type structural support, supporting side rails 142 and 144 and maintaining the conventional watertight seal at the joints between roofing panels, along the length of the assembly. Portions of ribs 32, inside cavity 274, may be removed to allow additional light from skylight lens 130 to reach through the respective roof opening/aperture.

As part of the installation of upper diverter 146, a stiffening plate structure 148, illustrated in FIG. 7 and following the width dimension contour of the roof panel, is placed against the bottom surface of the respective roof panel at or adjacent the upper end of the aperture in the roof. Self-drilling fasteners 430 (FIG. 7A) are driven through a lower flange of upper diverter 146, described more fully hereinafter, through the metal roof panel and into stiffening plate structure 148, drawing the diverter, the roof panel, and the stiffening plate structure into facing contact with each other and thus trapping the roof panel between the stiffening plate and the diverter and closing off the interface between the panel and the diverter. Thus, stiffening plate structure 148 acts as a nut for tightening fasteners 430. Caulk or other sealant can be used to further reinforce the closure/sealing of the diverter/roof panel interface.

Stiffening plate 148 can also be used to provide lateral support, connecting adjacent ribs 32 to each other. Stiffening plate 148 is typically steel or other material sufficient to provide a rigid support to the skylight rail and closure structure at diverter 146.

Rail and closure structure 140 is configured such that the skylight subassembly can be easily fastened directly to the rails with rivets or other fasteners such as screws and the like as illustrated at 310 in FIG. 8D. The rail and closure structure 140 may also be designed to accept a safety/security guard, which acts as fall protection in the skylight aperture, before and/or while the skylight lens subassembly is installed.

Looking now to FIGS. 7A, and 10 through 12, upper end diverter 146 extends between rails 142, 144, and provides end closure, and a weather tight seal, of the rail and closure structure, at the upper end of the roof aperture, and diverts water around the upper end of the aperture, to the flat portion 114 of an adjacent panel. Diverter 146 generally fits the profile of the uncut rib 32, and thus generally overlies the uncut rib as suggested by rib mating surface 440 in FIG. 10, across the panel flat from the cut away gap 122. The upper ends of side rails 142 and 144 abut the downstream side of diverter 146 and the height of diverter 146 closely matches the height of the side rails. Bearing panel 400 of diverter 146 thus acts with bearing panels 240 of side rails 142 and 144, and an upper surface of lower closure 150, to form the upper surface of the rail and closure structure, to which the skylight lens frame 132 is mounted, as well as surrounding a channel which extends upwardly from the corresponding aperture in the roof panel.

Lower flange 410 of diverter 146 runs along, and parallel to, panel flat 14 of the respective roof panel. Diverter 146 also has a diversion surface 420, and fastener holes 430 along lower flange 410. Diversion surface 420 is, without limitation, typically a flat surface defining first and second obtuse angles with lower flange 410 and intermediate end panel 415. As indicated in FIG. 10, diversion surface 420 has relatively greater width "W1" on the side of the closure structure which is against the rib which is not cut, and a relatively lesser width "W2", approaching a nil dimension, adjacent rib gap 122, thus to divert water toward gap 122.

At the end of lower flange 410, which is closer to the closed rib, is a rib mating surface 440. At the end of lower flange 410 which is closer to the cut rib is a rib sealing portion 450 of the end panel 415, which functions as an end closure of the rib 32 on the lower side of gap 122, and further functions to divert water across the respective rib 32 and onto the flat 14 portion of the roof panel. Rib sealing portion 450 extends through gap 122 and across the respective otherwise-open end of the rib. Hard rubber rib plugs 460, along with suitable tape mastic and caulk or other sealants, are inserted into the cut ends of the rib on both the upstream side and the downstream side of the rib at gap 122. The upstream-side plug, plus tube sealants, serve as the primary barrier to water entry on the upstream side of gap 122. Sealing panel portion 450 serves as the primary barrier to water entry on the downstream side of gap 122, with plug 460, in combination with tube sealant, serving as a back-up barrier.

The cross-section profiles of plugs 460 approximate the cross-section profiles of the cavities inside the respective rib 32. Thus plugs 460, when coated with tape mastic and tube caulk, provide a water-tight closure in the upstream side of the cut rib, and a back-up water-tight closure in the downstream side of the cut rib. Accordingly, water which approaches upper diverter 146 is diverted by diversion surface 420 and flange 410 and secondarily by flange 415, toward sealing portion 450, thence through gap 122 in the rib, away from the high end of closure support structure 100 and onto the flat portion of the next laterally adjacent roof panel. Accordingly, so long as the flow channel through gap 122 remains open, water which approaches the skylight assembly from above upper diverter 146 is directed, and flows through, gap 122 and away from, around, the respective skylight assembly.

Figure 10:
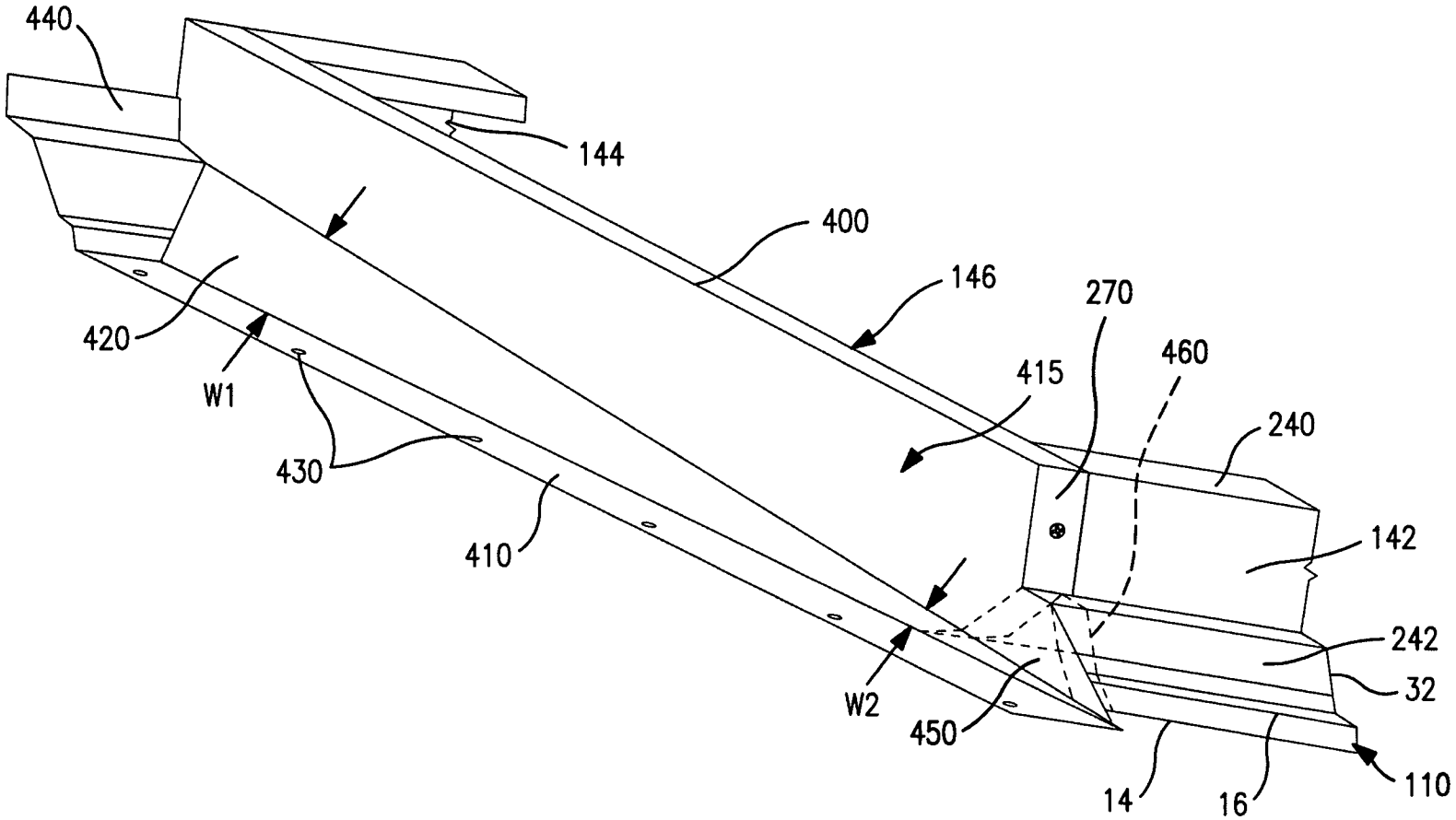
FIG. 10 is a perspective view of the upper diverter showing trailing closure flaps extending from the ends of the intermediate end panel, and closed over the upright sides of the respective side rails.
Figure 11:
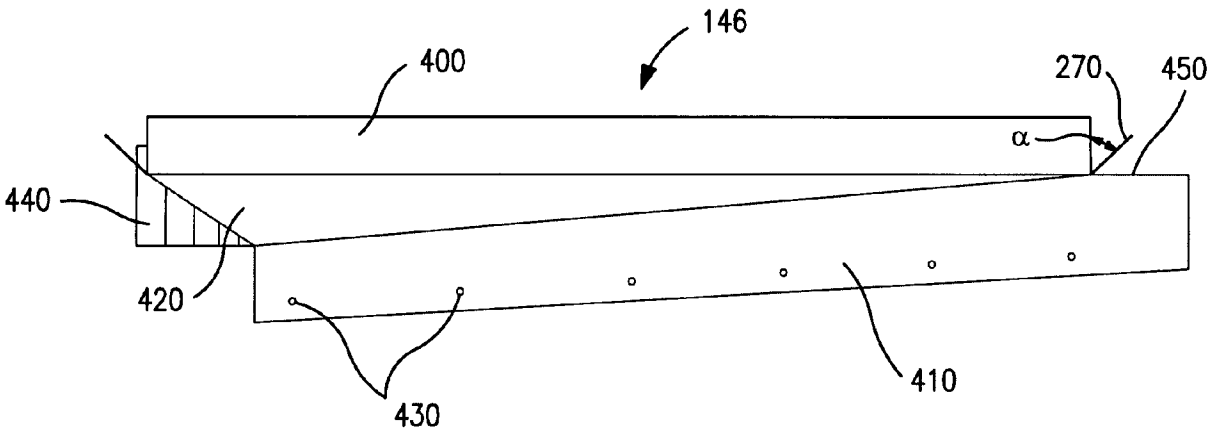
FIG. 11 is a top view of the upper diverter wherein trailing closure flaps extend from of the ends of the intermediate end panel and define acute angles with upright sides of respective side rails, before the trailing closure flaps are closed over the upright sides of the side rails.
Figure 12:
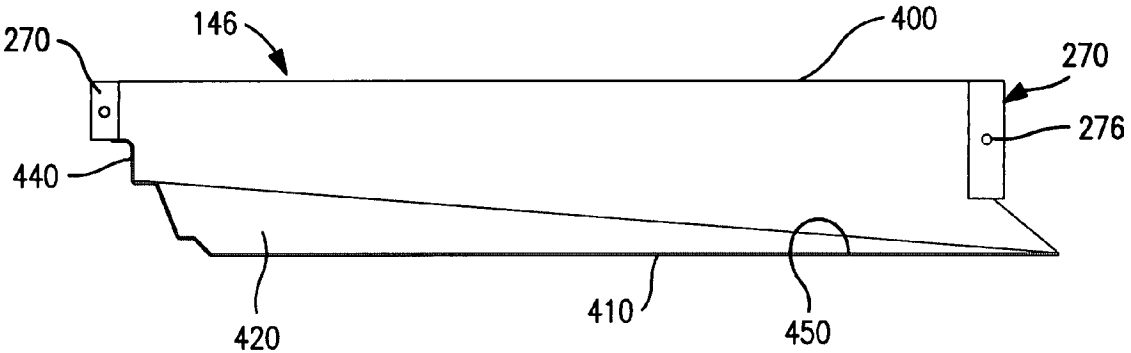
FIG. 12 is a front elevation view of the upper diverter.

FIGS. 7A, 10, and 11 show diverter ears 270 on opposing ends of the upper diverter. Ear 270 is shown in FIG. 11, in top view, at an angle $\alpha$ of about 45 degrees to the end of bearing panel 400 of the diverter. FIG. 10 shows an ear 270 after the upper diverter has been assembled to a rail, and the ear has been bent flat against the respective outer panel 238 of the rail.

After the ear has been bent flat against the rail outer panel, ear 270 is secured to outer panel 140 by driving a screw through aperture 276 and into the outer panel.

Figure 13:
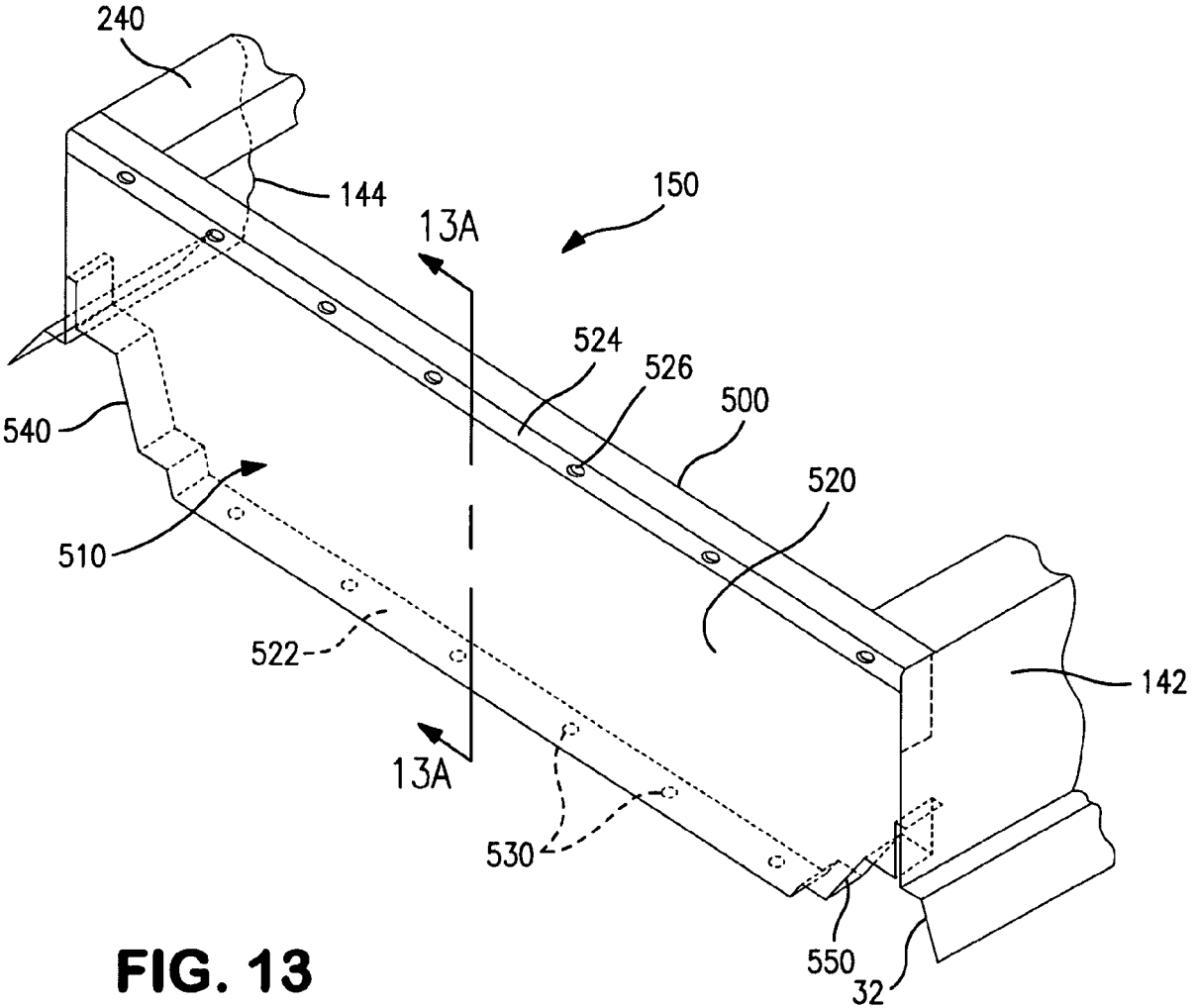
FIG. 13 is a perspective view of the lower closure.
Figure 15:
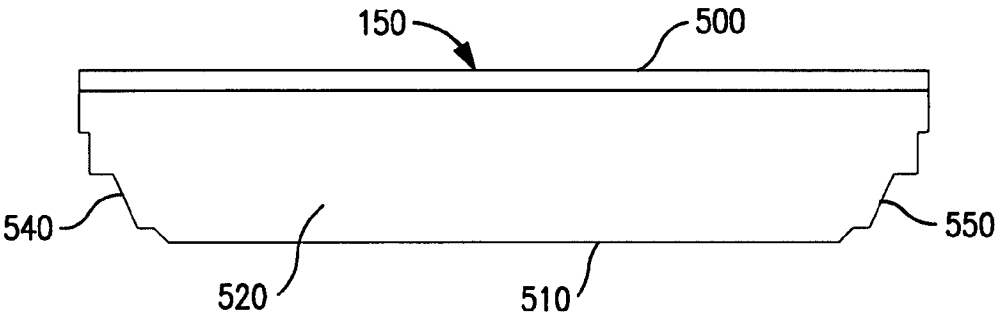
FIG. 15 is a front plan view of the lower closure.

FIGS. 9, 13, 13A, 14, and 15 show lower closure 150. The lower closure is used to establish and maintain a weather tight seal at the lower end of rail and closure structure 140, namely at the lower end of roof aperture 249. As illustrated in FIGS. 9, 13, and 15, the bottom of closure 150 is contoured to fit the profiles of ribs 32 as well as to fit the contour of panel flat 14. Bottom closure 150 abuts the lower ends of side rails 142 and 144, and the height of closure 150 matches the heights of side rails 142, 144.

Figure 13A:
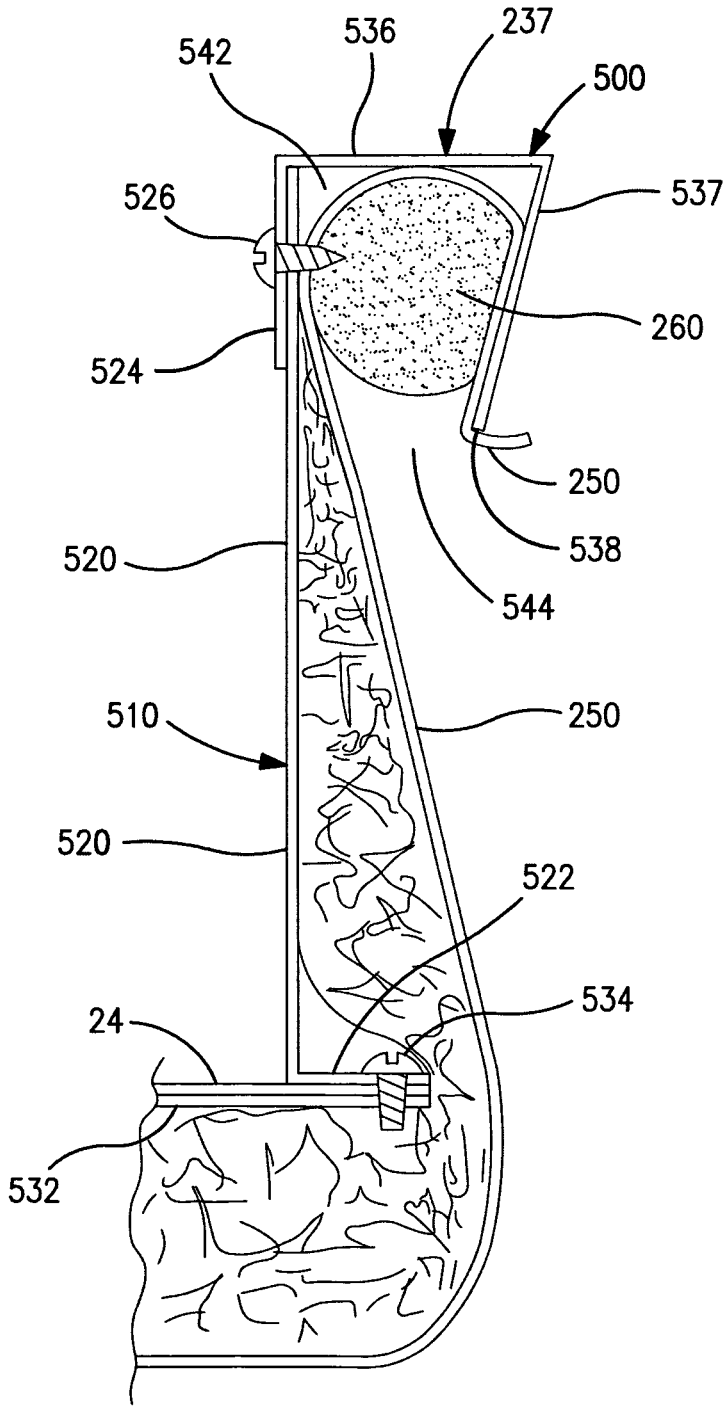
FIG. 13A is a cross-section taken at 13A-13A of FIG. 13, showing the relationships between the bottom portion of the lower closure and the overlying flange, showing the insulation facing sheet being held in the flange cavity by the thermally-insulating foam retainer rod, with the screws which mount the overlying flange to the bottom portion being embedded in the thermally insulating foam retainer rod, and showing a reinforcing plate under the flat of the metal roof panel at the lower closure, whereby the joint between the bottom flange of the bottom portion of the lower closure and the flat of the roof panel is supported by the reinforcing plate.
Figure 14:
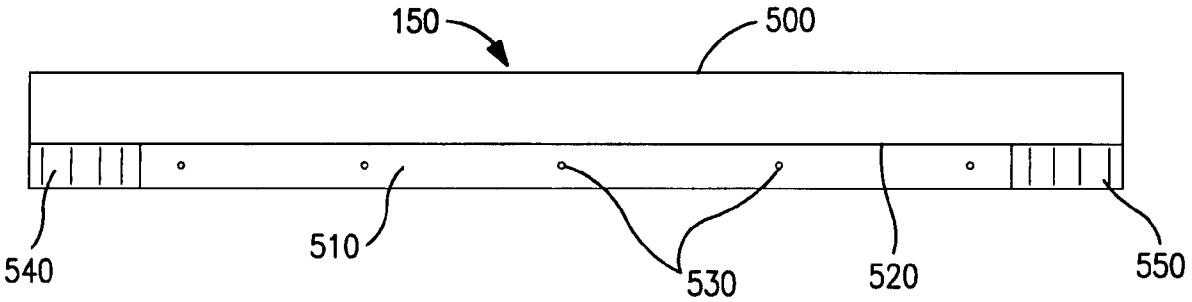
FIG. 14 is a top view of the lower closure.

Referring to FIGS. 13, 13A, lower closure 150 has a bottom portion 510 and an upper rail 500 secured to the bottom portion. Bottom portion 510 has a lower flange 522, as well as a closure web 520. Lower flange 522 is in-turned, namely flange 522 extends inwardly of closure web 520, toward the roof aperture and includes fastener holes 530. A stiff, e.g. steel, stiffener support plate 532 extends the width of the panel flat under lower flange 522. Self-drilling screws 534 extend through holes 530, through the panel flat, and into the stiffener support plate. Stiffener support plate 532 acts as a nut for the respective screws 534, whereby the screws can firmly secure the lower flange to the panel flat and providing support to that securement. Tube sealants can be used to enhance such closure.

Upper rail 500 is an elongate inverted, generally U-shaped structure. A first downwardly-extending leg 524 has a series of apertures spaced along the length of the rail, and screws 526 or other fasteners which extend through leg 524 and through closure web 520, thus mounting rail 500 to bottom portion 510.

Rail 500 extends, generally horizontally, from leg 524 inwardly and across the top of closure web 520, along bearing panel 536 to inside panel 537. Inside panel 537 extends down from bearing panel 536 at an included angle, between panels 536 and 537, of about 75 degrees to a lower edge 538.

Thus, the upper rail of the lower closure, in combination with the upper region of closure web 520, defines a cavity 542 which has a cavity cross-section corresponding with the cross-sections of cavities 264 of rails 142, 144. As with cavities 264 of the side rails, foam retaining rod 260 has been compressed in order to force the rod through slot 544, capturing the facing sheet 250 between the retaining rod and the surfaces which define cavity 542. The facing sheet has been raised. Facing sheet 250 traverses cavity 542 along a path similar to the path through cavities 264. Thus, facing sheet 250 enters cavity 542 against the inner surface of lower flange 520, extends up and over/about rod 260 in the cavity, against panels 536 and 537, and back out of cavity 542 to a terminal end of the facing sheet outside cavity 542. The tension on facing sheet 250 holds edge portion 256 of the batting against bottom portion 510 of the lower closure.

The uncompressed, rest cross-section of rod 260 in cavity 542 is somewhat greater than the cross-section of slot-shaped opening 544 between inside panel 537 and closure web 520, whereby rod 260 is necessarily compressed while being inserted through slot 544 and into cavity 542. After passing through opening 544, rod 260 expands against panels 524, 536, and 537 of the cavity while remaining sufficiently compressed to urge facing sheet 250 against panels 524, 536, and 537 whereby facing sheet 250 is assuredly retained in cavity 542.

As with screws 300 which mount the skylight assembly to side rails 142, 144, upper diverter 146, and lower closure 150, screws 526 extend through rail 500, through closure web 520, and into rod 260, whereby rod 260 insulates the inside of the roof aperture from temperature differentials transmitted by screws 526, thereby to avoid the fasteners being a source of condensation inside space 274 below the skylight lens.

Upper rail 500 of the lower closure extends inwardly of closure web 520 at a common elevation with bearing panels 240 of the side rails. Collectively, the bearing panels of side rails 142, 144, lower closure 150, and upper diverter 146 form a common top surface of the rail and closure structure, which receives the skylight lens subassembly.

Closure 150 includes rib mating flanges 540 and 550, as extensions of lower flange 522, to provide tight fits along ribs 32.

A salient feature of closure support structures 100, relative to conventional curb-mounted skylights, is the reduction in the number of roof penetrations, namely roof apertures, required to provide daylight lighting to the interior of e.g. a building, as multiple skylight assemblies can be mounted along the length of a single elongate aperture in the roof, whereby fewer, though longer, apertures can be made in the roof. Namely, a single opening in the roof can extend along substantially the full length of a roof panel, if desired, rather than cutting multiple smaller openings along that same length, and wherein the single aperture can provide for an equal or greater quantity of ambient light being brought into the building through a smaller number of roof apertures.

Another salient feature of closure support structures 100, relative to conventional curb-mounted skylights, is the fact that the full lengths of the entireties of the sides, namely the side rails, are above the panel flats, namely above the water lines of the respective metal roof panels.

Yet another salient feature of closure support structures 100, relative to conventional curb-mounted skylights, is the provision of lateral leg 147 of the upper diverter, which diverts water laterally away from the upper end of the skylight installation/closure support structure.

Figure 16:
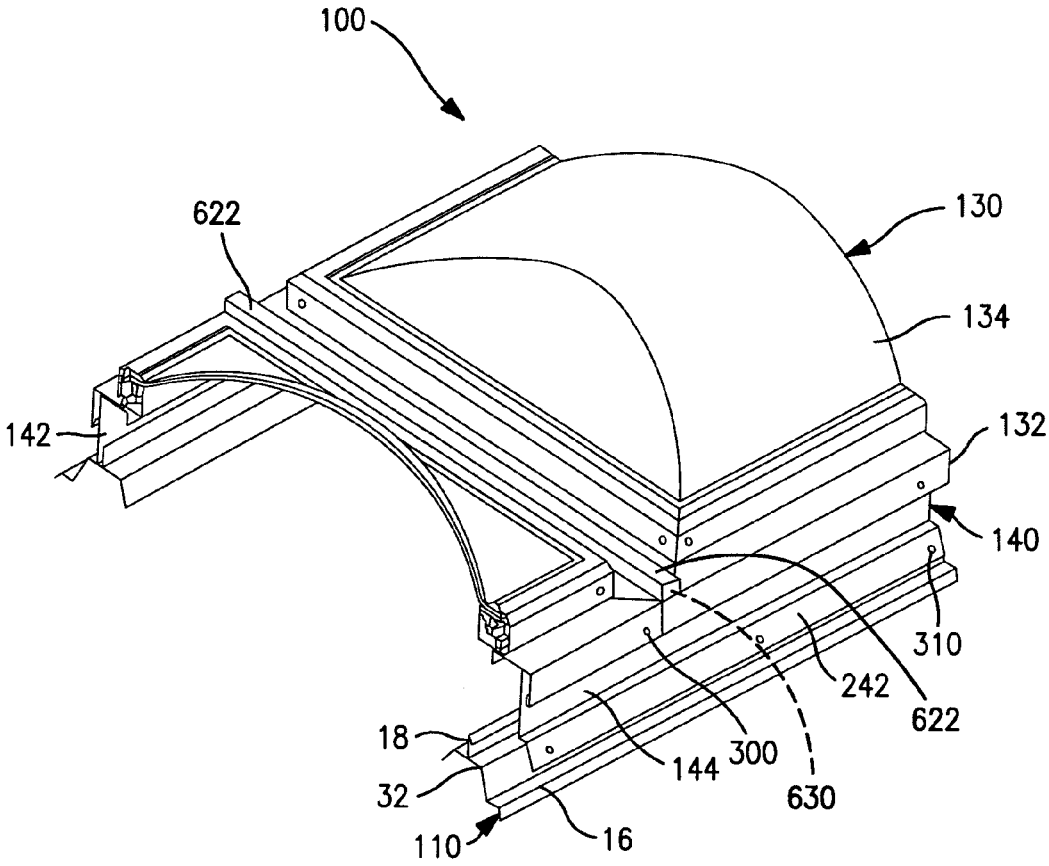
FIG. 16 is a perspective view, partially cut away, showing an end joint between facing ends of adjacent skylights of the system.
Figure 17:
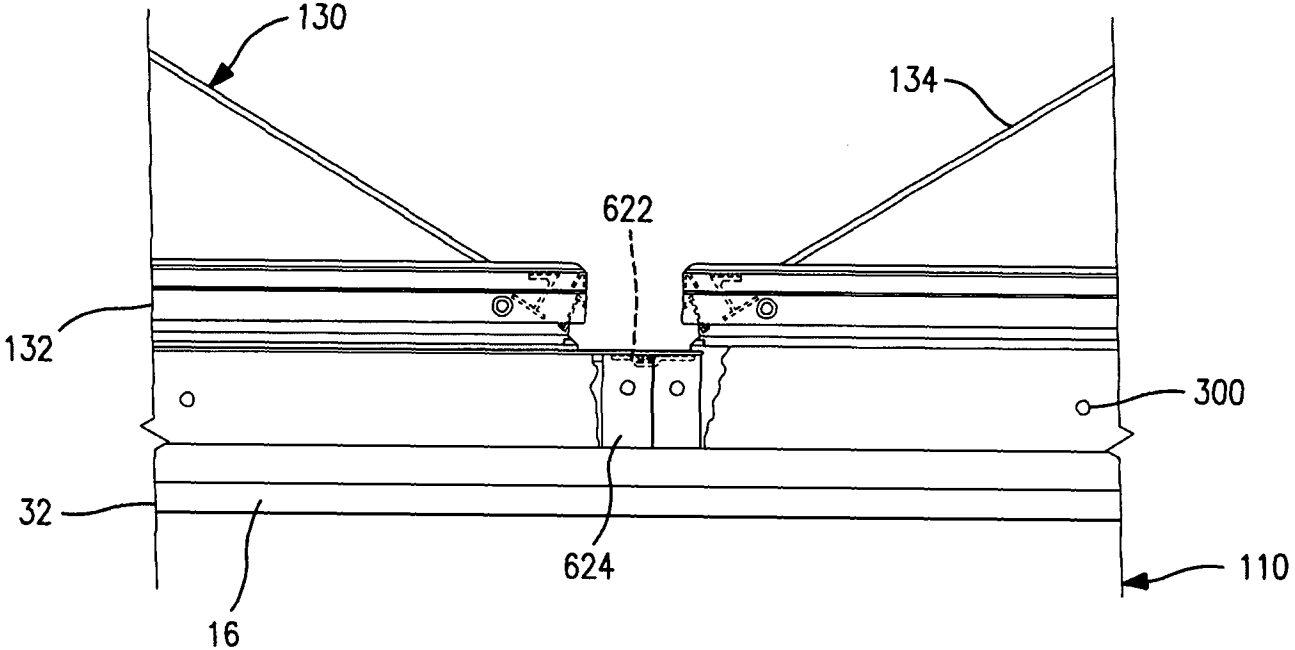
FIG. 17A show additional detail of the joint between facing ends of adjacent skylights.
Figure 17A:
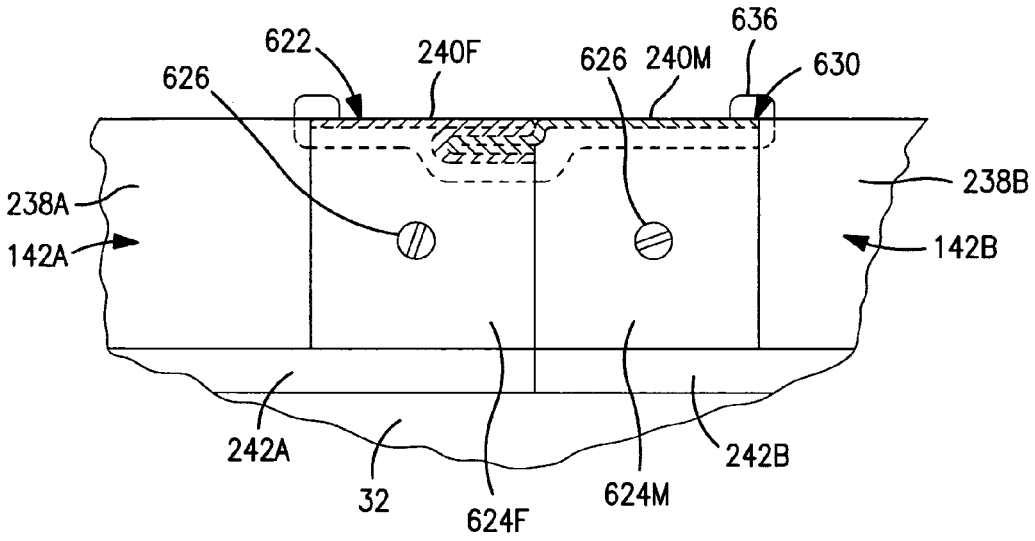

Closure support structures of the invention are particularly useful for continuous runs of e.g. skylights, where individual skylights are arranged end to end between the ridge and the eave of a roof. FIGS. 16, 17, and 17A show how the ends of two adjacent skylight assemblies can be joined to each other, end to end, in a strip of such skylight assemblies. Instead of installing an upper diverter and a lower closure with each of multiple skylight assemblies, rail 142A under the relatively up-slope skylight represents an upper end of a first side rail structure relatively up-slope on the roof, and abuts rail 142B under the relatively down-slope skylight and represents a lower end of the first side rail structure relatively down-slope on the roof. Rails 142A, 144A are mounted by rail shoulders 242A, 242B to rib 32. A female mating strip 622 extends across aperture 249 at the lower ends of a first pair of rails 142, 144, between rail 142A and the corresponding rail 144 on the other side of the aperture, including an intermediate portion of mating strip 622 displaced from both of side rails 142A and the corresponding side rails 144, in a constant cross-section illustrated in dashed outline in FIG. 17A. The extension of female mating strip 622 across the aperture includes a bearing panel 240F which extends between the opposing rails generally designated 142, 144. Securing panels 624F extend beyond both ends of bearing panel 240F and down over outer rail panels 238, only one panel 624F being shown, on the opposing rails 142, 144. Securing panels 624F extend down from bearing panel 240F and are secured to outer rail panels 238 by screws 626.

A male mating strip 630 extends across aperture 249 at the upper ends of a second pair of abutting rails 142B and a corresponding opposing rail 144, on the other side of the aperture in a constant cross-section illustrated in dashed outline in FIG. 17A. The extension of male mating strip 630 across the aperture includes a bearing panel 240M which extends between the opposing rails generally designated 142, 144. Securing panels 624M extend beyond both ends of bearing panel 240M and down over outer rail panels 238B, only one panel 238B being shown, on the opposing rails 142, 144. Securing panels 624M extend down from bearing panel 240M and are secured to outer rail panels 238 by screws 626.

Female mating strip 622 has a generally horizontally oriented elongate receptacle/slot 632 under the trailing edge of bearing panel 240F. Male mating strip 630 has a generally horizontally oriented elongate protuberance 634 stepped down from bearing strip 240F and extending from the leading edge of bearing panel 240M. Protuberance 634 is received in receptacle 632, thus to make the joint across aperture 249 for receiving the end members of the frame 132 of the relatively upstream and relatively downstream, skylight assemblies in the respective skylight strip assembly. A bead of tube sealant is laid in female receptacle 632 before protuberance 634 is mated with receptacle 632. Additional tube sealant is applied along the tops of mating strips 622 and 630 where bearing panels 240F and 240M meet.

A thin strip of thermally insulating foam 636 can be applied to the bottom surfaces of mating strips 622 and 630, bridging the joint at receptacle 632 and secured temporarily to the tops of bearing panels 240F, 240M. Placement of first and second skylight assembly frames 132 on the respective bearing panels 240F, 240M then secures the ends of the foam on the tops of the mating strips.

Mating strips 622 and 630 have been shown with the female slot/receptacle and the male protuberance in horizontal orientations. Similar mating strips can as well be designed wherein the male protuberance extends upwardly from bearing panel 240M; and the female receptacle is defined by a wall which extends upwardly from bearing panel 240F to a top, and then downwardly in defining a downwardly-opening elongate slot, both as illustrated in FIG. 16. Once again, the female mating strip is typically on the relatively upstream side of the joint and the male mating strip is on the relatively downstream side of the joint.

In the process of installing the closure support structure, the upper diverter is installed first, after cutting a small portion of the aperture near the diverter. Then the remainder of the roof aperture is cut in the respective roof panel and the rails are installed. The lower closure and mating strips are then installed, which defines the perimeter bearing surfaces for each skylight assembly. The skylight assemblies are then mounted on their perimeter bearing surfaces and secured to the rails. Tube sealant and tape mastic are applied, as necessary, at the respective stages of the process, including between the facing surfaces of the rails and the ribs, to achieve leak-free joints between the respective elements of the closure assembly. As an additional benefit, such sealant/mastic between the rails and the ribs inherently operates as a thermal break between the rails and the ribs.

The rails, with or without the upper diverter or the lower closure, depending on the presence, or not, of an aperture in the roof, can be installed on major rib elevations for any of the aforementioned roof panel profiles relative to the included flat portion of the respective roofing panel, so long as the rib structure can adequately support the contemplated load.

Figure 18:
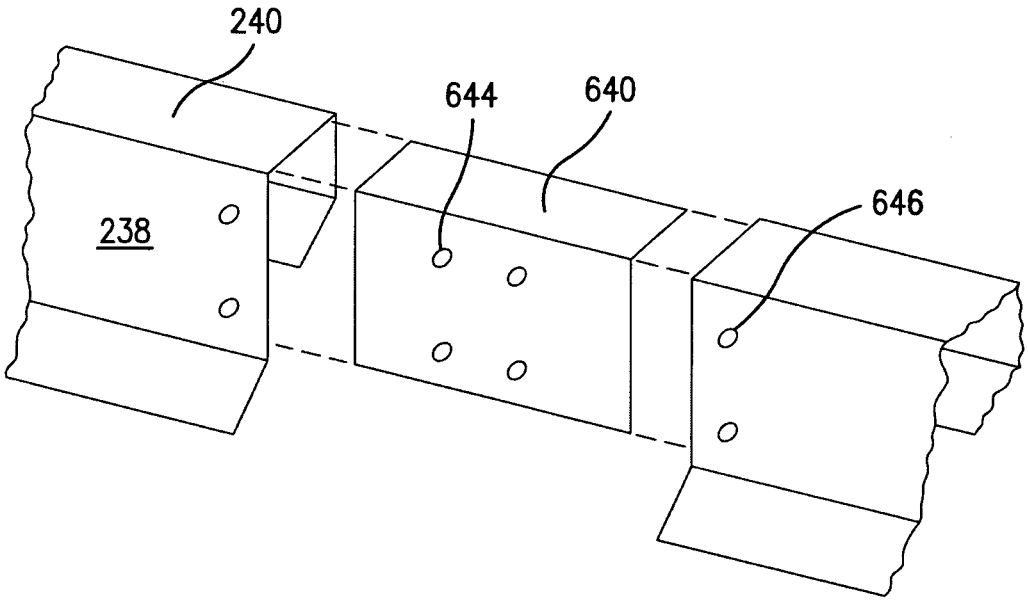
FIG. 18 shows an exploded pictorial view of a rail connector aligned with abutting rail ends and wherein the connector bridges the butt joint between rails which adjoin each other end to end, thus providing both reinforcement of the joint and enhanced sealing of the joint against intrusion of water.

Skylight assemblies of the invention can be connected end to end for as long a distance as necessary to cover a roof aperture, as each skylight assembly unit is supported by the ribs 32 of the respective roof panel through respective rails 142, 144. The standing rib elevations extend longitudinally along the full collective lengths of the respective rails, regardless of the number of skylight assemblies which are used to close off a given aperture in the roof. Water cannot enter over the tops of the rails because of the sealant at 330. Water cannot enter at the upper diverter at the uppermost skylight assembly because of the seal properties provided by the upper diverter, by bearing plate 148, and by the respective sealants, as well as because of the diversion of water away from the upper end of the strip of skylights through gap 122. Water cannot enter at the lower end because of the seal properties provided by the lower closure and by the sealants between the lower closure and the respective roof panel. Water cannot enter between the ends of the skylight subassemblies because of the tortuous path through receptacle slot 632 in combination with the sealants applied at the end-to-end joint FIG. 18 shows an exploded pictorial view of the ends of first and second rails in abutting relationship, which abutting relationship is also illustrated in part in FIG. 17A, such as where first and second skylights are arranged in a straight line direction in end-to-end relationship over a single roof aperture. Connecting plate 640 is configured to fit closely inside the cavity cross-sections defined by the respective rails, against the outer rail panels 238 and against the rail bearing panels 240. Connecting plate 640 is shown aligned with the abutting rail ends. The connecting plate is inserted into the cavities in the rails, bridging the butt joint between the rails. Apertures 644 in the connecting plate align with apertures 646 in the rails when the ends of the rails are in abutting relationship. Screws or other known aperture-to-aperture fasteners are used to securely fasten connecting plate 640 to both of the rails. Tape mastic and tube caulk are used, as known in the art for water seal closures, to fill the joint between the rail panels and the reinforcing connecting plate. As illustrated in FIG. 18, the length of connecting plate 640 is limited to the area of the joint between the two side rails, and provides both reinforcement of the joint and enhanced seal of the joint against intrusion of water.

If desired, rails 142, 144, upper diverter 146, and lower closure 150, can be increased in height to increase the distance/height between an upper portion of the rail and closure structure and the respective underlying roof panel. In the alternative, a height extension rail can be laid over or attached to the top of the rail and closure structure to provide a corresponding height increase. Such an extension can be produced to interface with the upper flange of the rail and closure assembly, to effectively raise the height of the skylight or smoke vent to accommodate different depths or other design features of the respective skylights, smoke vents, or other roof loads, or to accommodate snow conditions, anticipated snow depths, and the like. Where increased height is achieved by adding extensions to the rails, the upper diverter, and the lower closure, the elements of the rail and closure structure can be produced to a standard height, with extensions being used to elevate the overall height of the structure for such varied purposes. Various forms for such extensions can be suitable, and the skilled artisan will understand various ways and means of designing and manufacturing such extensions to achieve the goal of added elevation for the skylight lens.

As indicated above, the weight of the loads transferred by rails 142, 144 is transferred directly to ribs 32 of the respective underlying roof panels along the full lengths of the closure support structures; and only a minor portion, if any, of that weight is borne by the panel flat, and only at the high end and at the lower end of a load which overlies an aperture in the roof. Thus, the weight of the rails, or of the rail and closure assembly, is borne by the strongest elements of the roof panels, namely the ribs.

A wide variety of roof-mounted loads, in addition to skylights and smoke vents, is contemplated to be mounted on rails 142, 144. Where the load overlies an aperture in the roof, the rail system provides for fewer apertures. Where the load does not overlie an aperture in the roof, the rail system allows the roof to carry the weights of a variety of loads without penetrating the roof for the purpose of extending the support path through openings in the roof to the underlying building structural members, also without adding framing or other bracing under the roof panels to support the weight of such roof-mounted hardware, and thus avoiding water leaks associated with such openings, so long as the weight of such roof-mounted loads does not exceed the allowable load on the ribs. And where a roof-mounted load is e.g. an air conditioner, namely a load which does not require a roof opening, the upper diverter and the lower closure can be omitted. Further, in such instance, the rails can extend intermittently along the lengths of ribs 32, or shorter lengths of rails 142, 144, such as about 6 inches to about 12 inches length of such rails, can underlie only the left and right sides of upper and lower ends of the load.

The primary reason why the disclosed rail and closure structures do not leak is that a great portion of the perimeter of the closure, namely that which is defined by side rails 142, 144, is above the panel flat, namely above the water line on the roof panel; and all associated roof penetrations, such as screws 310 which mount the rails to the ribs, are above the water line. With little or no standing water at the surface-to-surface joints between the rails and the roof panels, even if the sealant fails at the joint, no substantial quantity of water routinely enters such failed joint because of the heights of those joints above the water line.

As a general statement, rail and closure structures of the invention close off the roof aperture from unplanned leakage of e.g. air or water through the roof aperture. The rail and closure structure 140 extends about the perimeter/sides of the roof aperture and extends from the roofing panel upwardly to the top opening in the rail and closure structure. The lens subassembly overlies the top opening in the rail and closure structure and thus closes off the top opening to complete the closure of the roof aperture.

Closure support structure 100 thus is defined at least in part by rail and closure structure 140 about the perimeter of the roof opening, and skylight lens subassembly 130, or the like, overlies the top of the rail closure structure and thus closes off the top of the closure support structure over the roof aperture.

Rail and closure structure 140 has been illustrated in detail with respect to one or more variations of the standing seam roofs illustrated in FIGS. 1, 3, and 5. In light of such illustrations, those of skill in the art can now adapt the illustrated rail and closure structures, by modifying, shaping of the structure elements, to support loads from any roof system which has a profile which includes elevations, above the panel flat, using standing joints or other raised elevations, such as, without limitation, those illustrated in FIGS. 2 and 4, as the locus of attachment to the roof.

While the figures depict a skylight, the rail structure, with or without end closures, can be used to mount a wide variety of loads on such roof, including various types of skylights, smoke vents, air conditioning, other vents, air intakes, air and other gaseous exhausts, electrical panels or switching gear, and/or other roof loads, including roof-penetrating structures, all of which can be supported on rail structures of the invention.

Although the invention has been described with respect to various embodiments, this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. Apparatus adapted to be assembled to form a closure support structure, wherein said closure support structure defines an upstanding enclosing wall having a top and extending about a perimeter of an aperture, wherein such aperture extends through a roof of a building, such roof of such building comprising a plurality of elongate metal roof panels which collectively define a plurality of elongate upstanding ribs extending between a ridge and an eave of such building, such ribs defining upstanding seams which have folded over terminal edges of the respective adjacent roof panels, such enclosing wall extending up from such roof and closing off access to such aperture from any side of such aperture, said apparatus comprising:

a plurality of closure members, having lengths, and being adapted to be mounted on such roof and about such aperture, said closure members, when assembled to each other on such roof, collectively providing said enclosing wall, the assembled closure members defining an outer perimeter of said enclosing wall which separates a surrounded space, over such aperture, from an ambient environment outside such enclosing wall, said enclosing wall comprising an upstanding outer panel, one or more cavity walls extending from said upstanding outer panel toward such aperture and defining respective cavity portions in the respective said closure members, said upstanding outer panel being disposed outwardly, away from the aperture, relative to such cavity portions, a layer of insulation being generally disposed under a such metal roof panel about such aperture, edge portions of said layer of insulation insulation extending upwardly through such aperture, further comprising a rod holding said layer of insulation in such cavity portion.

2. Apparatus as in claim 1, said closure members comprising (i) a first elongate side rail, comprising one or more elongate rail panels which define a first such cavity portion disposed, from the outer perimeter of said enclosing wall, toward such aperture, (ii) a second elongate side rail, comprising one or more elongate rail panels which define a second such cavity portion, (iii) an upper diverter, comprising one or more diverter panels which define a third such cavity portion, and (iv) a lower closure, comprising one or more lower closure panels which define a fourth such cavity portion.

3. Apparatus as in claim 1, a closure panel being mounted over said closure support structure and closing off access to such surrounded space, and one or more fasteners mounting said closure panel to said closure support structure, said fasteners terminating inside said rod.

4. Apparatus as in claim 1, said apparatus being assembled into a said closure support structure and mounted on such roof of such building about such aperture, such roof of such building comprising a sloping metal roof comprising a plurality of metal roof panels, each such roof panel having opposing sides, each such side of each panel defining a rib elevation, and a single panel flat between such ribs, said closure members comprising (i) a first elongate side rail, (ii) a second elongate side rail, (iii) an upper diverter, and (iv) a lower closure comprising a bottom portion and an upper rail, the bottom portion comprising (A) a closure web extending upwardly from the panel flat, and (B) a lower flange extending along, and generally at an elevation of, the respective panel flat of a given such metal roof panel, from said closure web, toward the roof aperture, said lower flange being secured to such roof panel at the panel flat, said upper rail being mounted to said closure web and extending, as a bearing panel, from said closure web toward the roof aperture, and extending, from said bearing panel, downwardly as an inside panel of the respective cavity portion, spaced from said closure web.

5. Apparatus as in claim 4, further comprising a stiffener support plate underlying said lower flange of said bottom portion of said lower closure, and self-drilling fasteners extending through said bottom portion, through the panel flat of the respective roof panel and into said underlying stiffener support plate, said stiffener support plate acting as a nut for the respective self-drilling fasteners whereby said self-drilling fasteners hold said lower flange, such roof panel, and said stiffener support plate firmly against each other, with such roof panel between said lower flange and said stiffener support plate.

6. Apparatus as in claim 1, said apparatus being assembled into a said closure support structure and mounted on a sloping such roof of such building about such aperture, said closure support structure comprising (i) first and second elongate side rails extending in a first straight-line direction mounted to such roof in end-to-end relationship, and a first connecting plate extending between and mounted to both of said first and second side rails, (ii) third and fourth elongate side rails extending in a second straight-line direction mounted to such roof in end-to-end relationship, and a second connecting plate extending between and mounted to both of said third and fourth side rails, (iii) an upper diverter extending between said first and third side rails at an up-slope end of said upstanding enclosing wall, and (iv) a lower closure.

7. A building, comprising a plurality of upright walls and a roof, apparatus as in claim 1 being mounted on said roof of said building.

8. Apparatus as in claim 1 wherein the cavity extends about substantially the entirety of the outer perimeter of said enclosing wall, and is disposed inwardly of the outer perimeter such that the cavity path is between the outer perimeter and such aperture.

9. Apparatus as in claim 1, said closure member elements extending, from the inner surface of said enclosing wall, into the surrounded space.

10. Apparatus as in claim 1, said one or more cavity walls and the respective upstanding seam defining a slot, and a corresponding access path, along a full length of the respective said closure member.

11. Apparatus as in claim 1, a layer of insulation being generally disposed under a such metal roof panel about such aperture, such layer of insulation comprising a vapor barrier sheet, and a layer of thermally-insulating batt material, edge portions of said vapor barrier sheet extending upwardly through such aperture, inwardly of the inner surface of said enclosing wall and up alongside said outer panel and being held inside a such cavity portion.

12. A closure support structure as in claim 11, further comprising a rod engaging said insulation in a such cavity portion.

13. A closure support structure mounted on a metal panel roof of a building, such roof comprising a plurality of elongate metal roof panels extending between a ridge and an eave of such building, said closure support structure defining an upstanding enclosing wall extending about a perimeter of an aperture in such roof, such aperture extending through such roof of such building, said closure support structure comprising a plurality of closure members, having lengths, mounted on such roof about such aperture, said closure members collectively providing said enclosing wall, said enclosing wall comprising an upstanding outer panel, one or more cavity walls extending from said upstanding outer panel toward such aperture and defining respective cavity portions in the respective said closure members, said upstanding outer panel being disposed outwardly, away from the aperture, relative to such cavity portions, one or more of said cavity walls collectively at least in part defining a slot portion, which slot portion defines an access path into at least one of the respective cavity portions, a layer of insulation being generally disposed under a such metal roof panel about such aperture, such layer of insulation comprising a vapor barrier sheet, and a layer of thermally-insulating batt material, edge portions of said vapor barrier sheet extending upwardly through such aperture, inwardly of the inner surface of said enclosing wall and up alongside said outer panel and being held inside a such cavity portion.

14. Apparatus as in claim 13, an upwardly-extending portion of such thermally-insulating batt material extending upwardly through such aperture inwardly of said enclosing wall and being disposed between said vapor barrier sheet and one or more of said closure members.

15. A closure support structure defining an upstanding enclosing wall extending about a perimeter of an aperture, wherein such aperture extends through a roof of a building, such enclosing wall extending up from such roof and closing off access to such aperture from any side of such aperture, said closure support structure comprising a plurality of closure members, having lengths, and being mounted on such roof and about such aperture, said closure members collectively providing said enclosing wall, said closure members comprising (i) a first elongate side rail, (ii) a second elongate side rail, (iii) an upper diverter, (iv) a lower closure, such roof of such building comprising a plurality of elongate metal roof panels which collectively define a plurality of elongate upstanding ribs extending between a ridge and an eave of such building, each such roof panel having opposing sides, each such side of each panel defining a rib elevation, the rib elevations of adjacent such roof panels being joined together to form first and second ribs, and a single panel flat extending from the first rib to the second rib, full lengths of said first and second side rails being mounted on the adjacent ribs on opposing sides of such single panel flat.

16. Apparatus adapted to be assembled to form a closure support structure, wherein said closure support structure defines an upstanding enclosing wall having a to and extending about a perimeter of an aperture, wherein such aperture extends through a roof of a building, such roof of such building comprising a plurality of elongate metal roof panels which collectively define a plurality of elongate upstanding ribs extending between a ridge and an eave of such building, such ribs defining upstanding seams which include folded over terminal edges of the respective adjacent roof panels, such enclosing wall extending up from such roof and closing off access to such aperture from any side of such aperture, said apparatus comprising:

a plurality of closure members, having lengths, and being adapted to be mounted on such roof and about such aperture, said closure members, when assembled to each other on such roof, collectively providing said enclosing wall, the assembled closure members defining an outer perimeter of said enclosing wall which separates a surrounded space, over such aperture, from an ambient environment outside such enclosing wall, said enclosing wall comprising an upstanding outer panel, one or more cavity walls extending from said upstanding outer panel toward such aperture and defining respective cavity portions in the respective said closure members, said upstanding outer panel being disposed outwardly, away from the aperture, relative to such cavity portions, one or more of said cavity walls collectively at least in part defining a slot portion, which slot portion defines an access path into at least one of the respective cavity portions, said side rails comprising outer rail panels extending upwardly from such ribs, a rib space being disposed below the folded-over terminal ends and above underlying portions of such ribs, and between a such upstanding seam and a respective panel of a said side rail, further comprising a cut-away gap (122) extending through one of such first and second ribs, cut ends of the respective such rib being disposed on opposing sides of such gap, exposing such rib space at such gap, further comprising, at such cut-away gap through such rib which exposes such rib space, a closely-fitting short rib plug (243) disposed in one of the cut ends, in the rib space, between the folded-over terminal ends and the respective panel of the respective said side rail.

17. Apparatus adapted to be assembled to form a closure support structure, wherein said closure support structure defines an upstanding enclosing wall having a to and extending about a perimeter of an aperture, wherein such aperture extends through a roof of a building, such roof of such building comprising a plurality of elongate metal roof panels which collectively define a plurality of elongate upstanding ribs extending between a ridge and an eave of such building, such enclosing wall extending up from such roof and closing off access to such aperture from any side of such aperture, said apparatus comprising:

(i) a first elongate side rail, comprising one or more elongate rail panels which define a first such cavity portion, (ii) a second elongate side rail, comprising one or more elongate rail panels which define a second such cavity portion, (iii) an upper diverter, comprising one or more diverter panels which define a third such cavity portion, and (iv) a lower closure, comprising one or more lower closure panels which define a fourth such cavity portion, said upper diverter comprising an upstanding end panel (415) extending between said first and second side rails and facing such ridge of such building, and diverter ears extending from said end panel and folded over said side rails, on a fold line which is generally perpendicular to such panel flat, and secured to, said side rails.

18. Apparatus adapted to be assembled to form a closure support structure wherein such closure support structure extends about a perimeter of an aperture, wherein such aperture extends through a sloping metal roof of a building, such sloping metal roof of such building comprising a plurality of elongate metal roof panels, each such roof panel having opposing sides, each such side of each panel defining a rib elevation, the rib elevations of adjacent such roof panels being joined together to form ribs, and a single panel flat being disposed between adjacent ones of such ribs, such closure support structure extending up from such roof and closing off access to such aperture from any side of such aperture, said apparatus comprising:

(a) a plurality of closure members adapted to be mounted on such roof and about such aperture in such roof thereby to provide such closing off of access to such aperture, said closure members comprising (i) a first elongate side rail, (ii) a second elongate opposing side rail, (iii) an upper diverter extending from such roof, and (iv) a lower closure extending from such roof, said lower closure comprising a bottom portion and a separate and distinct upper rail, the bottom portion comprising, as a single element, (A) a closure web adapted to extend upwardly from such roof, and (B) a lower flange connected to said closure web, said lower flange, when mounted to an underlying such metal roof panel as part of said lower closure, extending from said closure web, generally at an elevation of the panel flat of such underlying metal roof panel, and toward such aperture, said upper rail being disposed at the top of said lower closure, and being mounted to said bottom portion by fasteners, and extending, as a bearing panel, from said closure web toward such aperture.

19. Apparatus as in claim 18, said apparatus being assembled into a said closure support structure and mounted on such sloping roof of such building about such aperture, said lower flange extending along, and generally at an elevation of the respective panel flat of a given such metal roof panel, from said closure web, toward such roof aperture, said upper rail being mounted to said bottom portion and lying in overlying relationship with respect to said lower flange and extending, across open space from said closure web, toward such roof aperture, and downwardly at a location spaced from said closure web.

20. Apparatus as in claim 18, said apparatus being assembled into a said closure support structure and mounted on such roof of such building about such aperture, further comprising a closure panel mounted over said closure support structure and closing off access to such surrounded space.

21. Support structure apparatus adapted to be assembled to form a closure support structure mounted on a sloping roof of a building, wherein said support structure comprises a plurality of closure members which, when assembled to each other, extend from said sloping roof to a top of said closure support structure, and which closure members collectively further define an outer perimeter of said closure support structure, which separates a surrounded space, over an aperture, from an ambient environment outside such closure support structure, such aperture extending through such roof of such building, said closure support structure extending from an up-slope end thereof on such roof to a down-slope end thereof on such roof, and extending in an upward direction from such roof of such building and closing off access to such aperture from any side of such aperture, said apparatus comprising (i) first and second side rails adapted to be mounted to such roof, extending in a first straight-line direction, and in end-to-end relationship, with a first joint between said first and second side rails, as a first side of such closure support structure, (ii) third and fourth side rails adapted to be mounted to such roof, extending in a second straight-line direction, and in end-to-end relationship, with a second joint between said third and fourth side rails, as a second opposing side of such closure support structure, (iii) an upper diverter adapted to extend between said first and third side rails at the up-slope end of such closure support structure, and (iv) a lower closure, the combination of said first and second side rails, said third and fourth side rails, said upper diverter, and said lower closure, when so assembled on such roof, collectively defining an opening through such support structure above, and axially aligned with such aperture.

22. Support structure apparatus as in claim 21, further comprising, as part of said support structure apparatus, at least one mating strip adapted to extend across such opening, from side rail to side rail, and being disposed between, and displaced from, the up-slope end and the down-slope end of such closure support structure, so as to divide the surrounded space at a top of said closure support structure into first and second distinct elements of such space, said at least one mating strip further comprising a bearing panel extending across such surrounded space and being adapted to receive closure structure thereon, overlying respective elements of such surrounded space.

23. Support structure apparatus as in claim 21, said apparatus being assembled into a said closure support structure and mounted on such roof of such building about such aperture, a first side of said closure support structure comprising said first and second elongate side rails extending in the first straight-line direction and in end-to-end relationship, with a first joint between said first and second side rails, a first connecting plate extending between said first and second side rails across the first joint and being limited in length to the area of the first joint, and mechanical fasteners extending through the first connecting plate and through the first and second side rails, and thereby connecting respective end portions of the first and second side rails to each other, a second opposing side of said closure support structure comprising said third and fourth elongate side rails extending in the second straight-line direction and in end-to-end relationship, with a second joint between said third and fourth side rails, a second connecting plate extending between said third and fourth side rails across the second joint and being limited in length to the area of the second joint, and mechanical fasteners extending through the second connecting plate and through the third and fourth side rails, and thereby connecting respective end portions of the third and fourth side rails to each other, said upper diverter extending between said first and second sides at the up-slope end of said closure support structure, said lower closure extending between said first and second sides at the down-slope end of said closure support structure.

24. Support structure apparatus as in claim 23, said side rails, said upper diverter, and said lower closure, defining bearing panels which collectively extend about a perimeter of said closure support structure in a common imaginary plane, and defining a top of said support structure, and as part of said support structure apparatus, at least one mating strip adapted to extend across the roof aperture and across such opening, from side rail to side rail, said at least one mating strip being adapted to be mounted to respective first and second ones of said side rails, with an intermediate portion of said at least one mating strip being displaced from all of said side rails, said upper diverter and said lower closure, said at least one-mating strip extending across the opening, starting from a location intermediate the up-slope and down-slope ends of said closure support structure and ending at a location intermediate the up-slope and down-slope ends of said closure support structure, said mating strip also including a mating strip bearing panel in the same imaginary plane, thereby to define a first bearing panel perimeter at the top of said support structure, adapted to receive a first closure panel which thereby closes off a first portion of the opening, and a second bearing panel perimeter, separate and distinct from the first bearing panel perimeter, adapted to receive a second different closure panel which thereby closes off a second different portion of the opening, the collective closure panels closing off the entirety of the opening.

25. Support structure apparatus as in claim 24, further comprising first and second closure panels overlying, and closing off the respective first and second portions of the opening, including over said at least one mating strip.

26. Support structure apparatus as in claim 25 wherein the first and second closure panels comprise first and second skylight lenses.

27. Support structure apparatus as in claim 26 wherein said first and second skylight lenses, collectively with portions of said closure support structure, overlie the entirety of the single roof aperture.

28. Apparatus adapted to be assembled to form a closure support structure, wherein said closure support structure extends about a perimeter of an aperture, wherein such aperture extends through a roof of a building, said closure support structure extending up from such roof and closing off access to such aperture from any side of such aperture, said apparatus comprising:

a plurality of closure members, having lengths, and being adapted to be mounted on such roof and about such aperture, said closure members, when assembled to each other on such roof, collectively defining an outer perimeter of said closure support structure which outer perimeter separates a surrounded space, over such aperture, from an ambient environment outside the outer perimeter, a said closure member comprising an upstanding outer panel, a rail upper flange extending from said upstanding outer panel toward such aperture, and a rail inside panel extending from said rail upper flange at an included acute angle with said rail upper flange.

29. Apparatus as in claim 28, said apparatus being assembled into a said closure support structure and mounted on a metal panel roof of such building about such aperture, such roof of such building comprising a plurality of elongate metal roof panels, each having an elongate panel flat, and elongate rib elements on opposing sides of such panel flat, such rib elements on adjacent ones of such roof panels cooperating with each other to define elongate upstanding ribs extending between a ridge and an eave of such building roof, said closure support structure comprising (a) a first elongate side rail structure mounted on a first such rib, said first side rail structure having a first upper end relatively up-slope on said roof and a first lower end relatively down-slope on said roof, (b) a second elongate side rail structure mounted on a next adjacent rib across a single panel flat from said first side rail structure, said second side rail structure having a second upper end relatively up-slope on said roof and a second lower end relatively down-slope on said roof, (c) an upper diverter extending between the first and second upper ends of said first and second rail structures, and (d) a lower closure extending between the first and second lower ends of said first and second rail structures, said upper diverter comprising (i) a lower flange, said lower flange engaging a first such rib, and extending from the first such rib across the respective single panel flat, in general surface-to-surface alignment with, and in contact with, such panel flat, to a next adjacent second such rib, and across a gap in such second rib and onto a next adjacent panel flat, and (ii) an upstanding panel extending generally upwardly from said lower flange, and extending generally from the first rib to the second rib, and across the second rib at the gap, said upstanding panel having a lower edge and an upper edge, said lower edge extending at an angle which proceeds down the slope of such roof between such first rib and such second rib.

30. A closure support structure defining an upstanding enclosing wall having a top and extending about a perimeter of an aperture, wherein such aperture extends through a metal panel roof of a building, said enclosing wall comprising an upstanding outer panel extending up from such roof to a to of said enclosing wall, said enclosing wall closing off access to such aperture from any side of such aperture, said closure support structure comprising:

a plurality of closure members, having lengths, and mounted on such roof about such aperture, said closure members collectively providing said enclosing wall, said enclosing wall having an inner surface and an outer surface, said enclosing wall separating a surrounded space, over such aperture, from an ambient environment outside said enclosing wall, a layer of insulation being disposed under, and proximate, a such metal roof through which such aperture extends, an upstanding portion of said layer of insulation extending up from under such metal roof, through the aperture, and up alongside, and contacting, said outer panel and thereby providing thermal insulation between the surrounded space and said enclosing wall.

31. A closure support structure as in claim 30, said layer of insulation comprising a vapor barrier layer and said layer of thermally-insulating material, said layer of thermally-insulating material being disposed between said vapor barrier layer and at least a lower portion of said outer panel.

32. A closure support structure as in claim 31, a portion of said vapor barrier layer being disposed against an upper portion of said enclosing wall.

33. A closure support structure mounted on a metal panel roof of a building, such roof comprising a plurality of elongate metal roof panels extending between a ridge and an eave of such building, said closure support structure defining an upstanding enclosing wall extending about a perimeter of an aperture in such roof, such aperture extending through such roof of such building, said closure support structure comprising a plurality of closure members, having lengths, mounted on such roof about such aperture, said closure members collectively providing said enclosing wall, said enclosing wall comprising an upstanding outer panel, one or more cavity walls extending from said upstanding outer panel toward such aperture and defining respective cavity portions in the respective said closure members, said upstanding outer panel being disposed outwardly, away from the aperture, relative to such cavity portions, one or more of said cavity walls collectively at least in part defining a slot portion, which slot portion defines an access path into at least one of the respective cavity portions, a layer of insulation being generally disposed under a such metal roof panel about such aperture, edge portions of said layer of insulation extending upwardly through such aperture, inwardly of the inner surface of said enclosing wall and up alongside, and contacting, said outer panel.

34. A closure support structure as in claim 33, said layer of insulation comprising a vapor barrier and a layer of thermally-insulating batt material, further comprising a rod engaging said vapor barrier sheet in a such cavity portion.

* * * * *